US007432900B2

(12) United States Patent
Takahashi et al.

(10) Patent No.: US 7,432,900 B2
(45) Date of Patent: Oct. 7, 2008

(54) LIQUID CRYSTAL DISPLAY DRIVE METHOD

(75) Inventors: Kenichi Takahashi, Kanagawa (JP); Tadaaki Isozaki, Kanagawa (JP)

(73) Assignee: Sony Corporation, Tokyo (JP)

( * ) Notice: Subject to any disclaimer, the term of this patent is extended or adjusted under 35 U.S.C. 154(b) by 668 days.

(21) Appl. No.: 11/074,426

(22) Filed: Mar. 8, 2005

(65) Prior Publication Data

US 2005/0162364 A1 Jul. 28, 2005

Related U.S. Application Data

(63) Continuation of application No. 09/867,124, filed on May 29, 2001, now Pat. No. 6,897,844.

(30) Foreign Application Priority Data

May 29, 2000 (JP) ..... 2000-159265

(51) Int. Cl.
*G09G 3/36* (2006.01)

(52) U.S. Cl. ..... 345/94; 345/87; 345/97

(58) Field of Classification Search ..... 345/87–100
See application file for complete search history.

(56) References Cited

U.S. PATENT DOCUMENTS 5,396,352 A * 3/1995 Kaneko et al. ..... 345/97
5,436,742 A 7/1995 Tnaka et al.
5,479,283 A 12/1995 Kaneko et al.
5,757,349 A 5/1998 Togashi
6,057,878 A 5/2000 Ogiwara et al.
6,271,819 B1 8/2001 Fujita
6,313,820 B1 11/2001 Helbing et al.
6,369,789 B1 * 4/2002 Ulrich et al. ..... 345/97
6,417,826 B1 7/2002 Bonnett et al.
6,417,828 B1 7/2002 Sato et al.
6,462,796 B1 10/2002 Kabe et al.
6,897,844 B2 * 5/2005 Takahashi et al. ..... 345/94
2005/0156847 A1 7/2005 Takahashi et al.

FOREIGN PATENT DOCUMENTS

EP 0552886 A1 7/1993
JP 07-212686 8/1995
JP 09-044130 1/1997

OTHER PUBLICATIONS

D. Banas, et al. "Miniatue FLC/CMOS Color Sequential Display Systems," Journal of the Society for Information Display, vol. 5, pp. 1-8 (1997).

(Continued)

*Primary Examiner*—David L Lewis
(74) *Attorney, Agent, or Firm*—Sonnenschein Nath & Rosenthal LLP

(57) ABSTRACT

There is provided a liquid crystal display drive method that uses a drive voltage waveform consisting of a display signal period (display waveform 32 bits) and a control signal period irrelevant to display (control waveform 2 bits) in a given time or a period of plural frames or one frame. This method suppresses generation of internal DC voltage and thus prevents impurity ions from deteriorating the quality of displayed pictures.

13 Claims, 25 Drawing Sheets

OTHER PUBLICATIONS

D. G.Vass, et al., "Ferroelectric Liquid Crystal over Active Silicon Technology for Displays", SPIE Journal, vol. 3013, pp. 174-184 (1977).

K.M. Johnson, et al., "Smart Spatial Modulators Using Liquid Crystals on Silicon", IEEE Journal of Quantum Electronics, vol. 29, No. 2, Feb. 1993.

* cited by examiner

V2=V4, V1=V3, t1=t2=37.5 μs, t3=112.5 μs

LIQUID CRYSTAL DISPLAY DRIVE METHOD

RELATED APPLICATION DATA

The present application is a continuation of U.S. patent application Ser. No. 09/867,124 filed May 29, 2001, entitled, "LIQUID CRYSTAL DISPLAY DRIVE METHOD," which claimed priority to Japanese Application No. P2000-159265 filed May 29, 2000, both of which are hereby incorporated by reference.

BACKGROUND OF THE INVENTION

The present invention relates to a method for driving a liquid crystal display device such as a liquid crystal light modulator.

In recent years, there has been growing demand for higher performance projection type displays for use as large displays for personal theaters, flat displays for personal computers and the like.

Studies have been conducted concerning liquid crystal displays (hereinafter called LCD) as a type of display device which comprehensively meets the demand. An LCD can be a low-profile, lightweight model which provides a high picture quality with low power consumption.

Currently available LCDs use either the STN (Super Twisted Nematic) birefringence mode or the TN (Twisted Nematic) mode. Furthermore, next-generation LCDs such as ferroelectric and antiferroelectric LCDs which use the birefringence mode have been studied and are expected to be commercialized in the near future. In addition to already commercialized STN displays, research in FLC (Ferroelectric Liquid Crystal) as a typical birefringence LCD has been actively conducted since the SSFLC (Surface Stabilized Ferroelectric Liquid Crystal) was proposed.

Usually in ferroelectric liquid crystals, state 1 and state 2 concerning the orientation of liquid crystal molecules M with respect to externally applied electric field E (Ps denotes spontaneous polarization) are switched in the chiral smectic (C) phase, as shown in FIG. 1. As viewed from above, the central axis of a virtual cone shown in FIG. 1 coincides with the orientation of the alignment layer (rubbing direction for rubbing films, or evaporation direction for obliquely evaporated SiO films). A change in the orientation of liquid crystal molecules M is represented as a change in light transmittance when the liquid crystal element is placed between polarizer plates which are orthogonal to each other; as shown in FIG. 2, the transmittance sharply changes from 0% to 100% at threshold Vth with respect to the impressed electric field.

SSFLC displays are fast in response (approx. 1000 times faster than conventional nematic LCDs) and have the ability of memory, which solves the problem of flickers often seen in cathode ray tubes and TN displays. Even when a simple X-Y matrix drive is used, the drive can be performed with more than 1,000 scanning lines. Because an active device such as TFT (Thin Layer Transistor) is not used, the manufacturing yield rate can be improved.

Experiments on application of ferroelectric liquid crystals for reflective displays have been carried out. Some such experiments have been disclosed in detail in IEEE Journal of Quantum Electronics, vol. 29, no. 2 (1993)699, Journal of the Society for Information Display, vol. 5 (1997)1, SPIE, vol. 3013 (1977) 174, and so on. In these experimental displays, ferroelectric liquid crystal cells are made on a semiconductor memory and the memory voltage is used for drive.

The present invention's applicant et al have already proposed a reflective display which combines a semiconductor memory and ferroelectric liquid crystal. In this display technique, gradations can be expressed by combining the field sequential process and brightness modulation of the light source; in principle, the technique can express gradations which look continuously changing tones to the human eyes.

This reflective ferroelectric LCD has ferroelectric liquid crystal 4 filled between a transparent substrate 1*a* and a silicon substrate (silicon VLSI circuit board) 2*a*, as exemplified in FIG. 3. This reflective ferroelectric LCD is made by the following process. First, a transparent electrode 1*b* (ITO, etc) and obliquely evaporated SiO film or high molecular thin film (typically polyimide) are formed in the inner face of a transparent substrate 1*a* (glass, etc) by baking, then a liquid crystal alignment layer 1*c* is made by rubbing, and these are laid one upon another in a given order, to make a laminate. Similarly, a reflective film/electrode 2*b* (ITO, etc) and obliquely evaporated SiO film or high molecular thin film (typically polyimide) are formed in the inner face of a silicon substrate 2*a* having a drive circuit inside each pixel) by baking, and then a liquid crystal alignment layer 2*c* is made by rubbing. The transparent substrate 1*a* and the silicon substrate 2*a* are arranged so that these laminates are facing each other; a granular spacer 3 is put between them to make a prescribed liquid crystal cell gap; and ferroelectric liquid crystal 4 is filled into this cell gap and the area surrounding the gap is sealed using a glue.

The pixels in the ferroelectric liquid crystal device 11 shown in FIG. 3 have a 2-dimensional structure. As shown in FIG. 4, incident light 5 to the ferroelectric liquid crystal device 11 is reflected by the reflective film/electrode 2*b* to exit the ferroelectric liquid crystal device as reflected light 6. The light transmittance of the ferroelectric liquid crystal 4 which lies in the optical path for the incident light 5 and the reflected light 6 varies depending on the electric field between the electrode 1*b* and the reflective film/electrode 2*b*, as shown in FIG. 2. In short, since the intensity of the reflected light 6 is modulated by the strength of the electric field between the electrode 1*b* and the reflective film/electrode 2*b*, a picture can be displayed by switching between the reflective and non-reflective states of the incident light for each pixel.

The voltage impressed on the reflective film/electrode 2*b* is controlled for each pixel by a control circuit 7 which is located outside the ferroelectric liquid crystal device 11. However, it may be controlled by a circuit formed on the silicon substrate 2*a*. Impression of voltage may be done by either scanning for each pixel or a plurality of pixels or scanning for all pixels at a time.

FIG. 5 shows a transparent liquid crystal device 21. The difference of this transparent liquid crystal device 21 from the reflective liquid crystal device shown in FIGS. 3 and 4 is that the drive electrode consists of a transparent ITO 12*b* on a glass substrate 12*a*. In this structure, the drive electrode is driven for each pixel by a control gate element 18 which consists of a TFT, and incident light 15 is transmitted as transmitted light 16 or intercepted by turning on or off the signal voltage. In a mode such as the SSFLC mode which has the effect of memory, a simple matrix drive as mentioned above, which does not use an active element, is possible.

In the TN mode, a continuous transition between the light and dark states can be made according to the effective field strength. On the other hand, it has been thought that in the SSFLC mode, it has been thought that since it features a bistability (or ability of memory) that the light transmittance (or reflectance) suddenly changes at the threshold of impressed voltage, only two states (light or dark) are selectable and middle tones between the light and dark states can be hardly controlled.

The methods for representing middle tones or gradations which have been suggested so far include: an area gradation method in which subpixels are provided and control is done according to the integrated area of the subpixels; and a multi-domain method in which microscopic inverted domains are handled by control of the amount of injected charges for each pixel. The former method has the following problems: practically a larger number of pixels are used, so the drive circuit is complicated and it is difficult to increase the resolution. The latter method has the problem that variation in temperature distribution or active element performance makes it difficult to achieve equal gradation characteristics for every pixel. Therefore, these methods cannot control gradations satisfactorily.

The present invention's applicant et al have proposed an LCD drive method in Japanese Patent Laid-Open Applications No. Hei 7-212686 and No. Hei 9-044130. In principle, this method is intended to digitally represent gradations which look continuously changing tones to the human eyes by using an on/off type spatial light modulator for reflected or transmitted light and combining the field sequential process with light source brightness modulation.

In this LCD drive method, one frame is divided into several sub-frames (defined as bit planes) and each bit plane is weighted by brightness modulation of the light source for gradation representation.

In other words, if a light source with the same light intensity is used, one frame of 16.7 msec is simply time-divided by 8 bits (0 to 256 gradation steps) to represent 8-bit gradations (256 steps). To this end, the ferroelectric liquid crystal must be completely driven in approx. 65.5 μsec. For 10-bit gradation representation, the time for driving the ferroelectric liquid crystal is 16.3 μsec. Considering the response speeds for currently available ferroelectric liquid crystal materials, it is difficult to realize this, so the impressed voltage must be increased to realize it.

As a solution, a light source whose intensity can be modulated is used to drastically lengthen the drive time for the ferroelectric liquid crystal which is determined by time-division of one frame. Here, for 8-bit gradation representation, if the light intensity of the light source can be modulated for 8 bits, it is sufficient to drive the ferroelectric liquid crystal in approx. 2.08 msec. For 10-bit gradation representation, the required drive time for the ferroelectric liquid crystal is approx. 1.67 msec. Therefore, this LCD drive method is practical since it suits the actual response speed of ferroelectric liquid crystals.

Here, a picture which consists of one gradation bit is called a "bit plane" and the time required for representing it is called a "bit plane time." As shown in FIG. 6, if 8-bit gradation is to be represented, the number of bit planes used is 8 and the sum of eight bit plane times constitutes one frame.

It is said that in the recent digital gradation representation method used in what is called "plasma display panels," 8-bit representation is sufficient for the minimum gradation quality but insufficient for higher picture quality.

On the other hand, digital gradation representation has a problem of false contours. This problem occurs due to a long bit plane time as a result of time division in field sequential drive: this phenomenon arises when the temporal shift of a light emitting pattern is converted into a spatial shift as the human eyes follow light emitting points. This problem can be reduced by shortening the bit plane time.

However, actually the lower limit for one bit plane time is determined by various factors such as ferroelectric liquid crystal drive response time, device structure, electric power consumption and data transmission rate. In addition to the problem of false contours, the upper limit for one bit plane time is determined by color splits, the number of gradation steps or other factors. Considering that the frame frequency is 60 Hz, usually one bit plane time should be set within the range from one hundred micron seconds to hundreds of micron seconds.

For instance, in a display device proposed by this applicant et al, 256 gradation steps are used for each of R (red), G (green) and B (blue); one frame consists of 108 bit planes (36 bit planes×3 colors); and one bit plane time is approx. 150 μsec. In this case, the ferroelectric liquid crystal is designed to be switched at least once for every bit plane.

In field sequential gradation representation, the drive voltage waveform for the ferroelectric liquid crystal must be used in one bit plane time and thus only a simple drive voltage waveform can be used. Besides, for high definition pictures, the unit pixel area is smaller and the relevant drive circuit must be built in that pixel area, which means that a simpler drive voltage waveform is required to reduce the load on the drive circuit, etc.

It is known that in the LCD manufacturing process, the liquid crystal comes to contain mixed or produced impurity ions at various steps such as liquid crystal synthesis, making of alignment layers and injection of liquid crystal, which leads to a deterioration in the quality of displayed pictures.

At present, it seems impossible to remove impurity ions in a liquid crystal panel completely. Even if they can be completely removed, impurity ions are newly generated when a voltage is impressed to drive the LC panel. Behavior of these impurity ions in the liquid crystal panel is considered as follows:

(1) A temperature rise, voltage impression or the like encourages dissociation of ions in the liquid crystal.

(2) Electrically charged ions move along the electric field in the liquid crystal generated by impression of voltage.

(3) As ions reach the alignment layer, they are adsorbed physically or chemically.

(4) If the waveform of the voltage impressed on the cell is alternating, ions are adsorbed and released repeatedly.

(5) Some of the dissociated ions return to neutral molecules by re-bonding of ions.

In this ionic behavior, if any of the following asymmetric conditions occurs in the two facing electrode substrates for drive, asymmetric ionic behavior arises in the interface between the liquid crystal and alignment layer.

(1) Structural asymmetry between two facing electrode substrates (between a TFT substrate and an ITO substrate, or between a reflective substrate and a transparent substrate in a reflective cell)

(2) Asymmetry in various conditions of the alignment layers on two facing electrode substrates (layer thickness, baking condition, rubbing strength, etc.)

(3) Asymmetry in impressed voltage waveform (in case there is waveform asymmetry for GND though an AC waveform such as a rectangular waveform is used as a general drive voltage waveform)

These asymmetric conditions cause an adsorption/release imbalance in the interface of the cationic and anionic alignment layers or an ionic polarization imbalance in the two facing electrode substrates. In this condition of ionic polarization, relaxation is difficult, so there occurs a condition similar to one which occurs when a DC component (V') with a certain polarity is externally applied between liquid crystal cells.

This means that, even if voltage impression is stopped later, the condition that voltage V' is impressed or that a voltage is impressed on liquid crystal molecules, is maintained inside liquid crystal cells. In other words, even when symmetric rectangular waveform voltage (amplitude V) is impressed on liquid crystal cells, the effective voltage impressed inside the liquid crystal is (V+V') on the positive side and (−V+V') on the negative side and thus the effective voltage impressed on the liquid crystal is no longer symmetric. In LCDs like TN mode ones in which the effective voltage is reflected in the light transmittance, this asymmetry may cause liquid crystal molecules to waver, which would be observed as a phenomenon called a "flicker," one of the reasons for picture quality deterioration.

On the other hand, in the SSFLC mode, when a positive voltage signal (V) is used as the voltage signal for selecting one of the On state and Off state and a negative voltage signal (−V) as the voltage signal for selecting the other state, if V' has a positive value, application of a negative voltage signal has the effect of impression of (−V−V') while application of a positive voltage signal has the effect of impression of (V−V'). Therefore, response to the state chosen by the negative voltage signal is quickened by the effective voltage increment, while response to the state chosen by the positive voltage signal is slowed by the effective voltage decrement; also as V' increases, (V−V') does not reach the threshold, which means no response.

Under the above-said condition that the internal DC voltage component becomes larger, there is even a case that liquid crystal molecules themselves are electrolyzed. Recently, as the stability of liquid crystal materials increases, such electrolysis rarely occurs as far as the drive voltage is within a normal range; however, there still remains the possibility of picture quality deterioration being caused by the effective DC component of drive voltage waveform.

For the above reason, it has been believed that it is a good practice to keep the LCD drive voltage waveform electrically neutral and use an AC drive system in which positive and negative voltages alternate and are symmetrical with respect to 0 V as seen in rectangular waveforms with an offset voltage of 0 V, sinusoidal, cosine and triangular waveforms.

For example, TN mode LCDs use rectangular waveforms with 0 V offset voltage for drive and rectangular waveforms for TFT gate element drive in order to keep the drive voltage waveform electrically neutral.

In SSFLC mode LCDs, the following drive method has been used: when applying a pulse voltage to select either the On state or the Off state, the voltage waveform with the reverse polarity is combined to offset the DC component within one selection time or reverse polarity voltage pulses are inserted so as to offset the DC component on the average over a longer time (e.g. plural frames).

However, in these SSFLC mode LCDs, in order to maintain electrical neutrality, voltage waveforms practically not contributing to liquid crystal drive have to be inserted for as long a time as the state selection voltage waveforms, which necessitates shortening of bit plane time with resultant deterioration in brightness and gradation characteristics. Still further, the time allowed for liquid crystal response is shortened, which increases the load on the liquid crystal material.

SUMMARY OF THE INVENTION

In view of the above-said circumstances, the present invention provides a simple LCD drive method which ensures a sufficient bit plane time and prevents impurity ions from deteriorating the displayed picture quality.

The drive method according to the present invention offers an advantage that it suppresses internal DC voltage generation by impurity ions, taking it into consideration that there is the possibility of electrical neutrality being marred by variation in device characteristics even in an "AC drive" system which ideally uses rectangular waveform voltage with 0 V offset voltage to maintain electrical neutrality with no internal DC voltage generation.

According to one aspect of the present invention, the LCD drive method is based on the following LCD structure: a first electrode located on a first substrate and a second electrode located on a second substrate are facing each other and liquid crystal material is filled and sealed between the substrates. The LCD is driven by switching On and Off the voltage signal impressed between the first and second electrodes to select one of the two states of incident light: either reflected or non-reflected state; or either transmitted or non-transmitted state; or either polarized or non-polarized state. For example, in driving a liquid crystal light modulator, generation of internal DC voltage which might be caused by ionic polarization in liquid crystal cells can be efficiently suppressed by using drive voltage waveform consisting of a display signal period and a control signal period irrelevant to display, within a given drive time, or a period of plural frames or one frame.

According to another aspect of the invention, in the LCD drive method, it is preferable to use a combination of positive voltage signals for selecting one of the On and Off states and a combination of negative voltage signals for selecting the other state. Alternatively, a combination of positive and negative voltage signals may be used for selecting at least one of the On and Off states while differentiating the absolute values or durations of these voltages to generate internal voltage DC components.

Namely, in the LCD drive method according to the present invention, it is also possible to use any combination of positive voltage, negative voltage and/or 0 V signals for the drive voltage waveform for incident light state selection during the display signal period, wherein the absolute values of these voltages and their pulse widths are different and the impressed voltage waveform has an asymmetric condition that there may be an imbalance between positive and negative charges or the average voltage in a unit time is not zero.

When either the on state or the off state is selected, electrical neutrality is not maintained: i.e. a potential due to polarization of impurity ions or internal DC voltage is generated between the electrodes. To display a picture over a desired time period, the number of On times and the number of Off times are not always equal, or one type of state selection waveform is impressed more frequently than the other type, so internal DC voltage is generated between the electrodes within a given time period.

BRIEF DESCRIPTION OF DRAWINGS

Preferred embodiments of the present invention will be described in detail based on the followings, wherein.

DETAILED DESCRIPTION OF THE PREFERRED EMBODIMENTS

Figure 7:
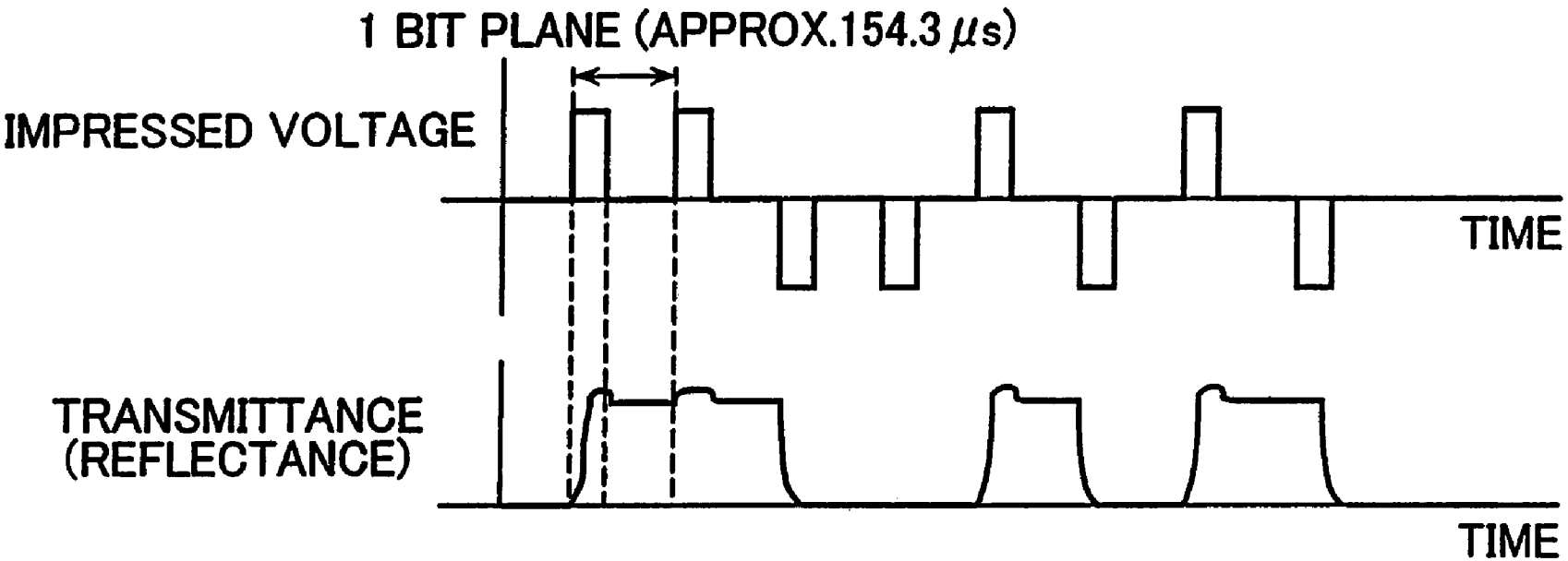
FIG. 7 is a timing diagram showing the relationship between impressed voltage and transmittance (reflectance) in each bit plane of the above-said LCD.

FIG. 7 shows the relationship of the drive voltage waveform supplied to an LCD vs. reflected light intensity. As shown in FIG. 7, a positive pulse (50 μsec) and a negative pulse (50 μsec) are applied to one bit plane (approx. 154.3 μsec) to select the On (light) state and the Off (dark) state, respectively. While GND voltage is being impressed, the reflected light intensity is almost held constant due to the bistability (ability of memory) of SSFLC.

In the SSFLC mode, the ability of memory is generally used but it is also possible to use cone angles inherent in ferroelectric liquid crystal materials, by means of simpler rectangular waveforms, etc., without using the ability of memory. In this case, or if the cone angle inherent in a ferroelectric liquid crystal material is used, the reflectance for each bit plane can be increased, though the actual brightness is not influenced.

In this way, when a drive voltage waveform which effectively generates internal DC voltage in the period of selection of one state is used in a given period, generation of internal DC voltage can be suppressed by inserting voltage waveform with the polarity reverse to that of internal DC voltage generated during the period, into a given time period or plural frames or part of one frame.

The key point in the present invention is that the drive for selecting either the On state or Off state is done by means of voltage signal generated by the effective internal DC voltage within the selection period, and also a waveform that controls (reduces) the level of the internal DC voltage which does not practically contribute to liquid crystal drive, such as reverse polarity voltage waveform, is inserted in a given period.

Ideally, the time of insertion of reverse polarity voltage waveform should be the same as the time of impression of drive voltage waveform (impressed voltage) for selection of a liquid crystal state, so that the state of electrical neutrality is attained. However, practically, if the reverse polarity voltage waveform which does not contribute to liquid crystal drive is inserted for as long a period as the state selection waveform is applied, the bit plane time must be shortened accordingly, which might cause a deterioration in displayed picture characteristics including brightness and gradation. To avoid such deterioration, the time of impressing a voltage waveform which controls (reduces) the level of internal DC voltage should be as short as possible.

The inventors of the present invention have developed an LCD drive method to ensure display reliability over an extended period as follows: instead of inserting the voltage waveform for controlling (reducing) the level of internal DC voltage for as long a period as the drive time for liquid crystal state selection, it is inserted for a period shorter than that, so that internal DC voltage generated by impurity ions can be very effectively reduced.

Internal DC voltage in an LCD is defined as a voltage between electrodes which is left after application of a drive voltage waveform. It is thought to be generated as a result of formation of an electric field by impurity ions in a liquid crystal cell which have been polarized by the effective DC component of the drive voltage waveform and the like.

Figure 8:
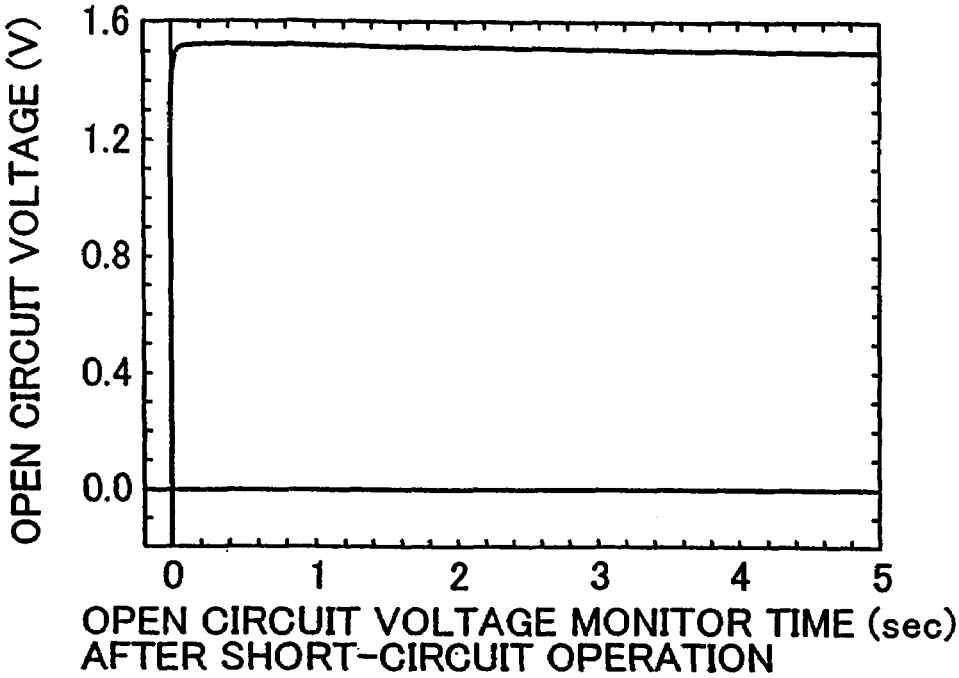
FIG. 8 is a graph showing the relationship of open circuit monitor time after short-circuit operation and the open circuit voltage in the above-said LCD, wherein asymmetric drive voltage waveform is applied.
Figure 9:
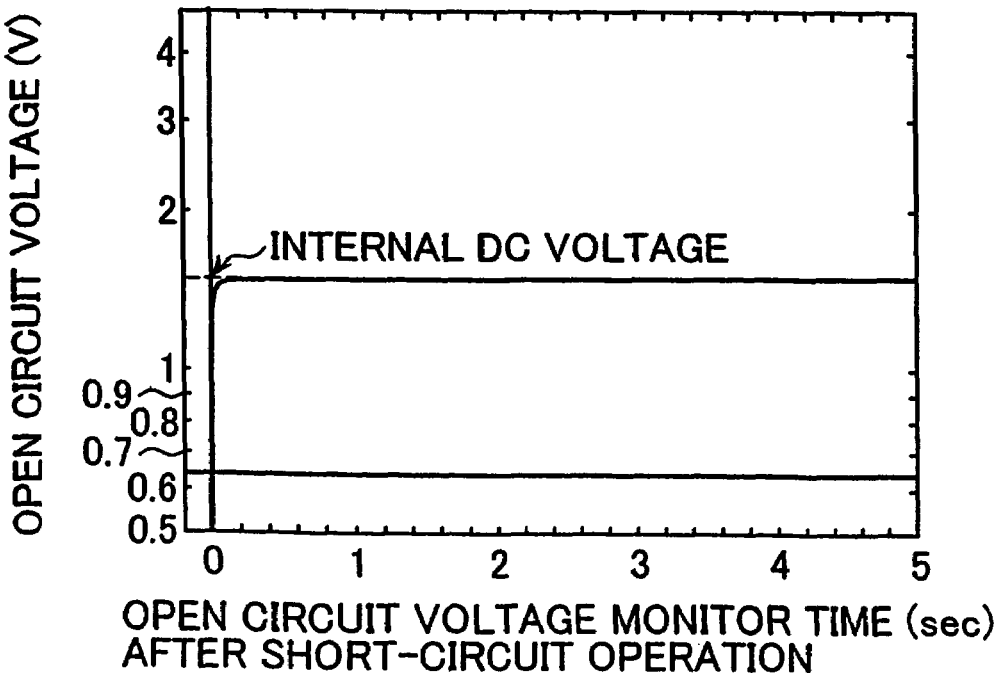
FIG. 9 is a graph showing the relationship of open circuit monitor time after short-circuit operation for calculation of internal DC voltage, and the open circuit voltage in the above-said LCD.
Figure 10:
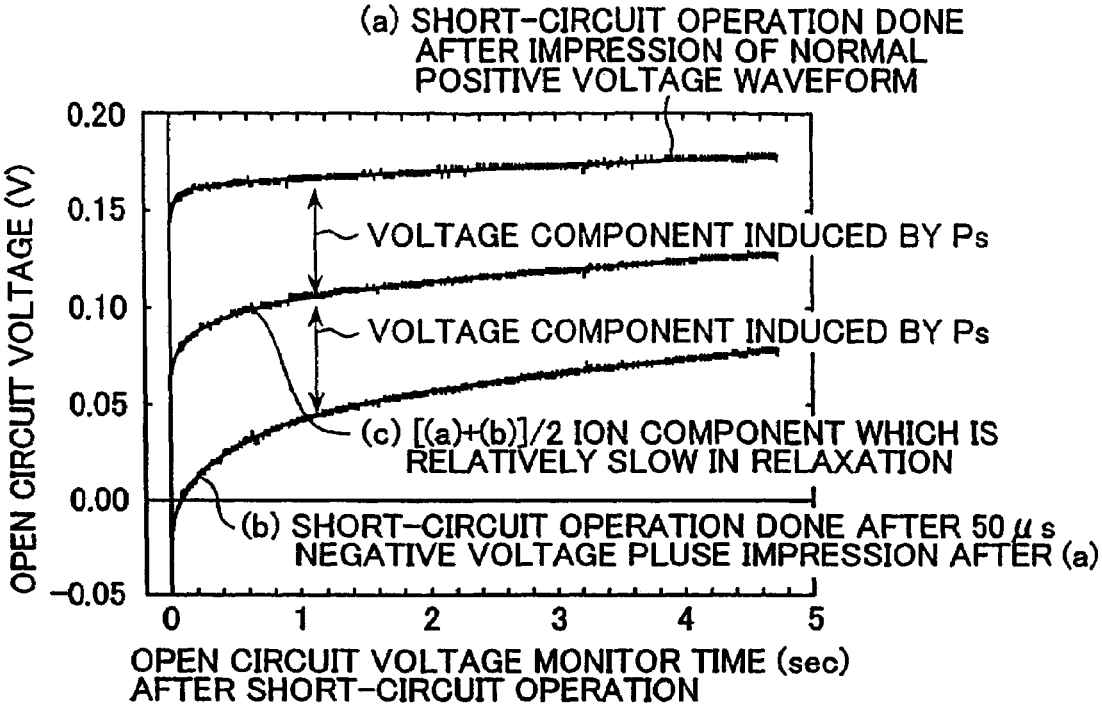
FIG. 10 is a graph showing the relationships of open circuit monitor time after short-circuit operation under different conditions, and the open circuit voltage in the above-said LCD.

When asymmetric drive voltage waveform is actually applied, the voltage of the DC component which is left between the electrodes is measured, as shown in FIG. 8. On the other hand, when the facing electrodes are symmetric to each other in the cell structure and a symmetric drive voltage waveform is applied, the internal DC voltage is zero if tolerable errors are omitted. The internal DC voltage is calculated as follows: as shown in FIGS. 9 and 10, during measurement, the time when an open circuit is made is assumed as 0, the voltage values to be monitored are plotted with a log scale and a value obtained by linear extrapolation of plateau values to time 0 is considered as an internal DC voltage value.

Because this internal DC voltage exists in a given period regardless of the drive voltage waveform, it is expected that there will be a phenomenon which looks as if the grounding potential (GND) of the drive voltage waveform is offset by the amount equivalent to the electric field formed by the internal DC voltage.

Next, preferred embodiments of the present invention will be described referring to the drawings.

(1) LCD Manufacturing Process

An explanation will be given below of the manufacturing process for LCDs to which the LCD drive method according to the present invention is applied.

Figure 1:
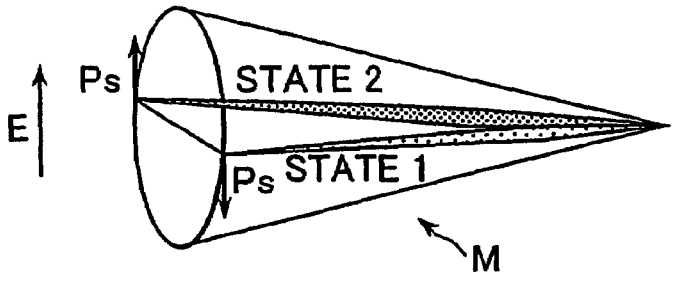
FIG. 1 is a perspective view illustrating the liquid crystal molecular structure in a ferroelectric LCD according to the present invention.
Figure 2:
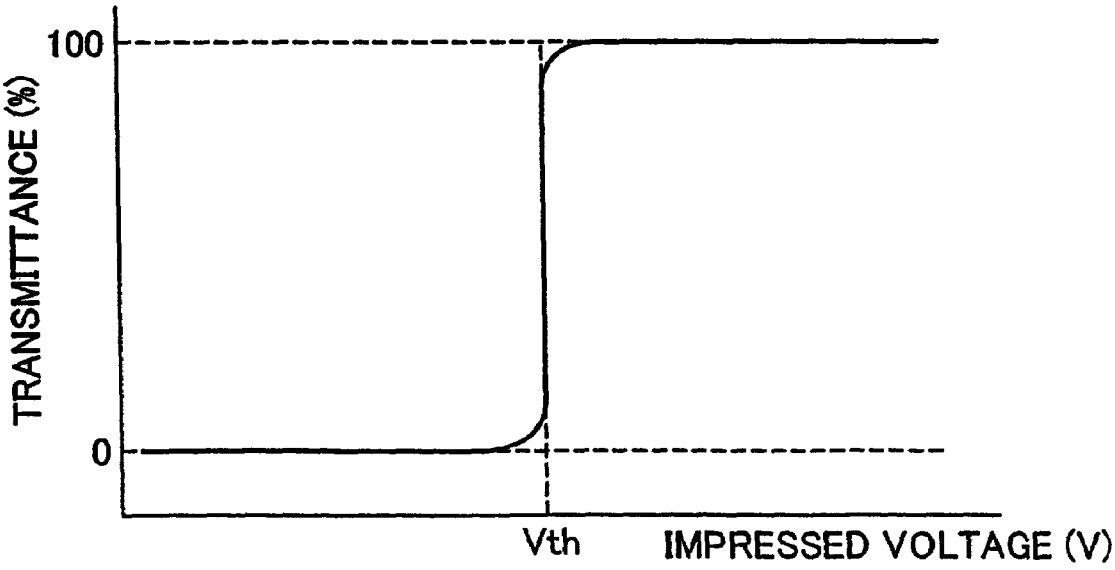
FIG. 2 is a graph showing the relationship between impressed voltage and transmittance in the above-said LCD.
Figure 3:
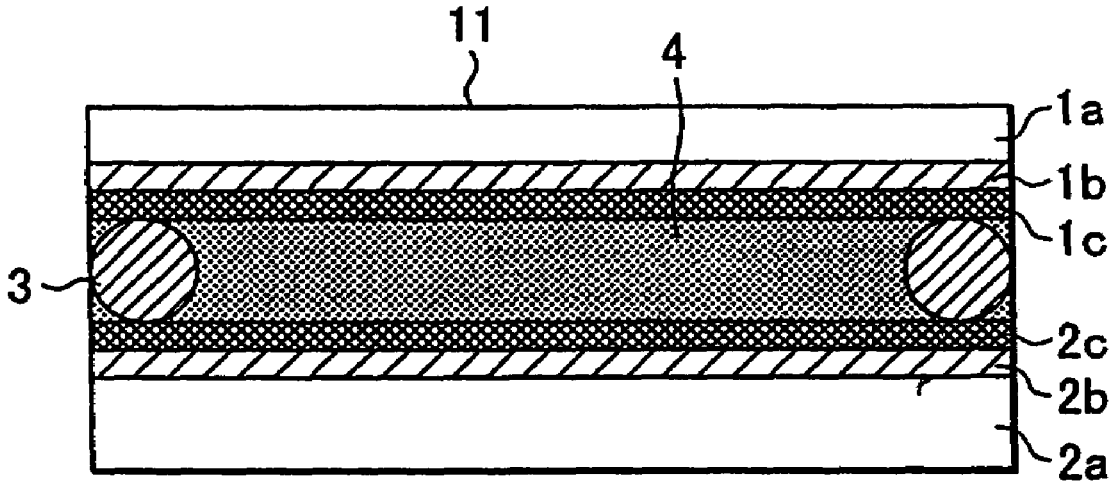
FIG. 3 is a longitudinal sectional view illustrating the structure of the above-said LCD.
Figure 4:
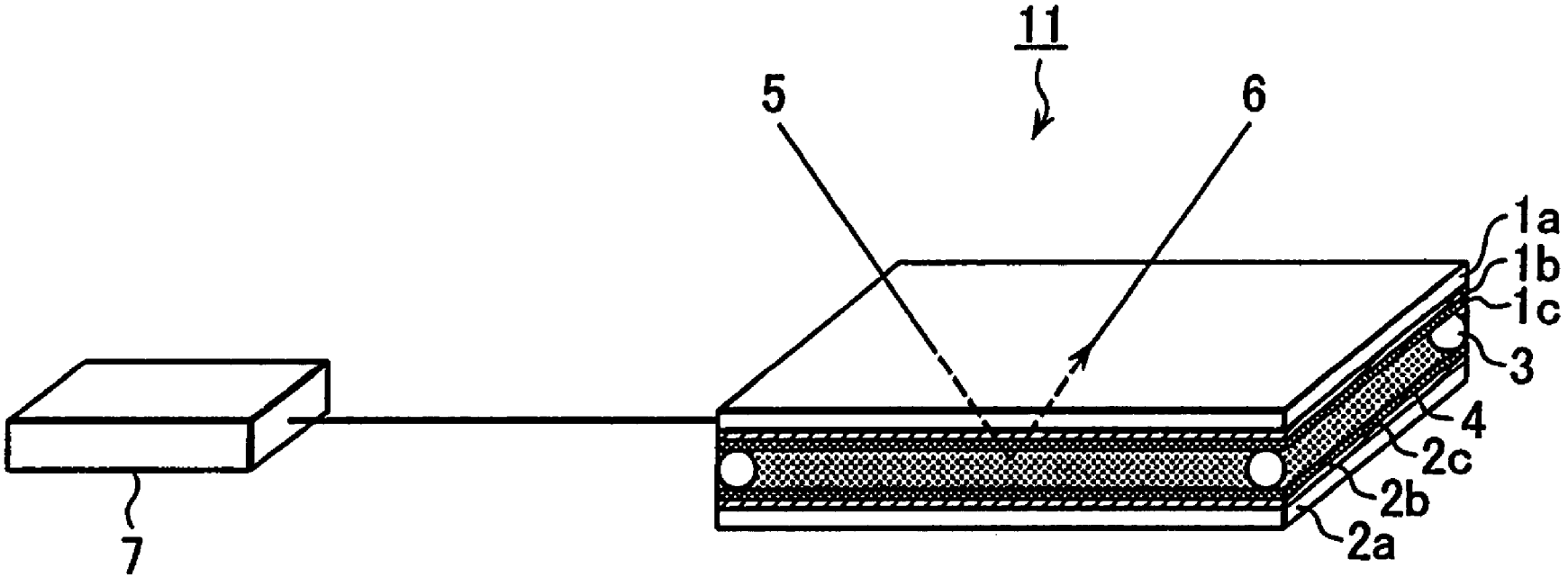
FIG. 4 is a perspective view illustrating reflection type operation of the above-said LCD.
Figure 5:
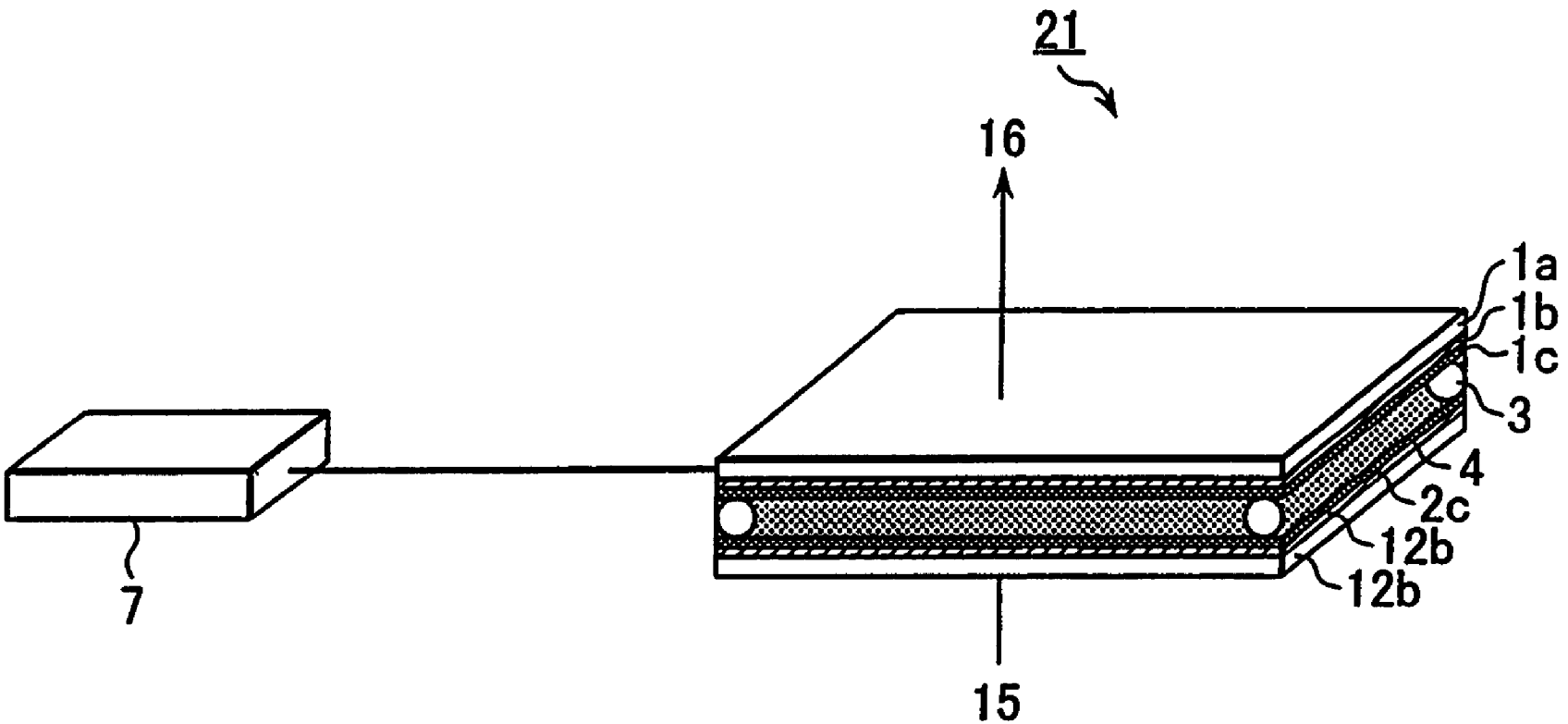
FIG. 5 is a perspective view illustrating transmission type operation of the above-said LCD.
Figure 6:
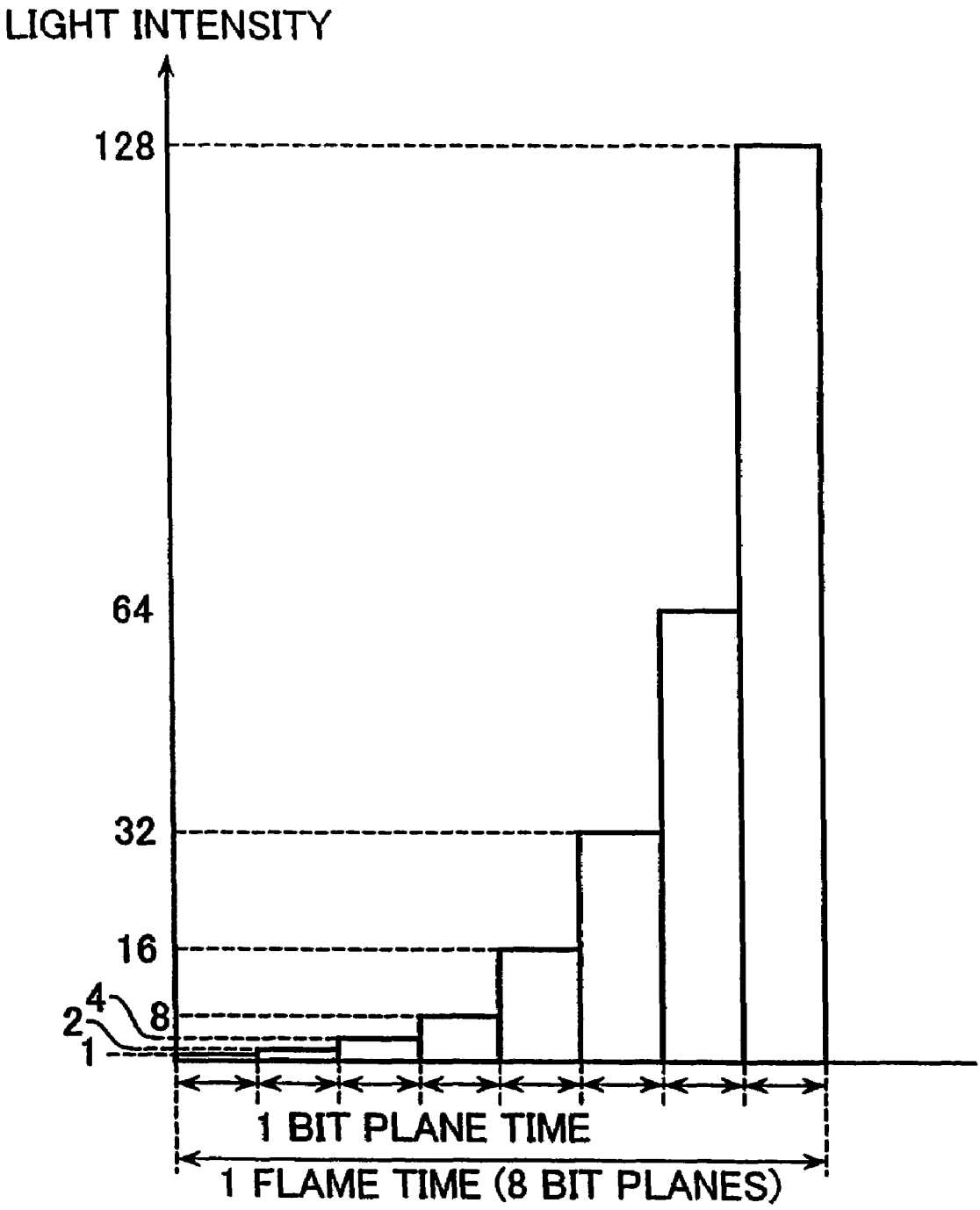
FIG. 6 is a graph showing the relationship between bit planes and light intensity within one frame time in the above-said LCD.

The panels used for the measurements described below are all transparent panels which have a transparent electrode on each of the upper and lower substrates, as shown in FIG. 5. The manufacturing process and reflected light response measuring method for reflective panels which have one substrate covered with an Al reflective film as shown in FIG. 3 are basically the same as for the transparent panels, except that in the reflective panels, reflected light passes through the liquid crystal twice and thus the effective retardation is twice as much as that of transparent panels which have an equal cell gap.

The following is a manufacturing process for LCDs. The whole process up to liquid crystal injection is performed in a clean room.

[Forming Transparent Electrodes]

First, a transparent layer of electrode material ITO is formed on one side of a glass substrate by the sputtering process and a transparent electrode with a prescribed pattern is formed by photolithography. This patterning process consists of the following steps:

(1) ITO Sputtering
(2) Resist Spin Coating
(3) Resist Film Pre-Baking and Baking
(4) Resist Film Exposing
(5) Resist Film Etching
(6) ITO Etching
(7) Cleaning
(8) Resist Film Stripping
(9) Cleaning

[Cleaning the Substrates]

The glass substrates are cleaned and dried in a clean room. This cleaning/drying process is performed, for example, using a 3-bath type ultrasonic washer like a model made by Sun Denshi Co., Ltd.

The first bath is used for alkali cleaning (SCAT×20) in which ultrasonic cleaning of a substrate is done at a bath temperature of 45□ for 3 minutes while the substrate is being vibrated.

The second bath is used for ultrasonic rinsing in which the alkali detergent is washed away by a pure water shower while the substrate is being vibrated; the substrate is subjected to 3-minute ultrasonic rinsing three times.

In the third bath, the substrate is immersed in pure water at a bath temperature of 80□ for one minute, then gradually pulled up out of the pure water by means of an elevator mechanism before being air-dried.

Furthermore, UV ozone cleaning is done at room temperature for 10 minutes using, for example, the UV dry stepper cleaner made by Samco International Inc.

[Making Alignment Layers]

Liquid crystal orientation methods are roughly classified into two types: One type is by rubbing of organic thin membranes and the other type is by oblique evaporation of inorganic materials such as SiO (silicon oxide). When rubbing membranes are used for alignment layers, the productivity is high and it is easy to produce large area displays. For this reason, recently there has been a growing trend for LCD manufacturers to use rubbing membranes for alignment layers. In contrast, if obliquely evaporated SiO films are used for alignment layers, a satisfactory memory ability can be obtained though productivity is not high.

In view of the above circumstances, we will discuss below about differences in liquid crystal orientation characteristics among LCD alignment layer materials. Here, alignment layer materials include obliquely evaporated SiO film and polyimide (for example, polyimide "AL0656" made by JSR Corporation) (hereinafter called PI).

[Obliquely Evaporated SiO Film]

Obliquely evaporated SiO film is manufactured by the following process. SiO (evaporation substance) as an evaporation source is housed in an evaporation port with a hole as a point source. The angle θ of the line connecting SiO and the point of evaporation with respect to the normal of the glass substrate evaporation plane is set to, for example, 85 degrees for evaporation. For film structural uniformity, the allowable error range for this angle θ should be only a few degrees. The distance between the evaporation source and the point of evaporation should be, for example, 40 cm or more because it affects the SiO pillar form and film thickness distribution.

[Rubbing Membranes]

Polyimide rubbing membrane alignment layers are made by the following process. First, the substrate is rotated at a prescribed rotational speed (e.g. 3,500 rpm) and an alignment layer PI material such as "AL0656" made by JSR Corporation is coated on it by a spin coating technique. Then, after baking at 180□ for four hours, rubbing is done under the following conditions: roller speed 300 rpm, stage speed 2 mm/sec, and pushing depth 0.200 mm.

[Assembling Cells]

Two glass substrates each of which have the above-mentioned alignment layer and ITO are prepared; the alignment layers are made to face each other to make their orientation parallel. UV curable resin made by dispersion of a gap material is coated on the alignment layer of one of the glass substrates, outside the display area, by seal printing. Recommended gap materials include a gap material made by Catalysts & Chemicals Ind. Co., Ltd (yarn balls with a diameter of 1.0 μm). One example of UV curable resin made by dispersion of such a gap material is a resin made by Toray Fine Chemicals (Photorec). The two glass substrates are joined and ultraviolet rays are irradiated on them to cure the resin to make a cell with a gap of 1.0 μm.

[Injection of Liquid Crystal]

Next, the liquid crystal element is left in a constant-temperature bath until its temperature rises to a level that makes it enter the isotropic phase; then the injection port in the cell is immersed in ferroelectric liquid crystal. Recommended ferroelectric liquid crystals include "CS-1031," "CS-1025" and "CS-1028" which are made by Chisso Corporation. After that, the cell is cooled down to the room temperature at the speed of 1□/min and taken out of the constant-temperature bath. Finally, the injection port is sealed, which concludes the assembly of an LC panel.

(2) Liquid Crystal Materials and Panel Components Suitable for use in Embodiments of the Present Invention As a ferroelectric liquid crystal material suitable for the LCD drive method according to the present invention, a mixture of chiral and non-chiral compounds is recommended; practically, one type of compounds or a mixture of two or more types of compounds may also be used.

Chiral compounds include pyrimidine, biphenyl and phenylbenzoate compounds (these ferroelectric liquid crystals may become chiral nematic or smectic as the temperature changes). There are such non-chiral compounds as biphenyl, terphenyl and tricyclic-cyclohexyle, cyclohexyle, biphenylcyclohexane, cyclohexylethane, ester, pyrimidine, pyridazine, ethane and dioxane compounds.

Instead of any of the above ferroelectric liquid crystal materials, an antiferroelectric liquid crystal material is also usable. Besides, a nematic liquid crystal material for TN or STN mode may be used as well.

Regarding liquid crystal device components, transparent glass plates for substrates, ITO or aluminum for electrode layers, and polyimide films made by rubbing or obliquely evaporated SiO films for liquid crystal alignment layers may be used. In addition to ITO, transparent materials such as tin oxide and indium oxide may be used as materials for electrode layers. For transparent substrates, spacers and sealants for LCDs, various materials which have been conventionally used for these purposes are usable. If a reflective LCD is to be made, a material with high reflectance such as aluminum and silver may be used for reflective layers.

Liquid crystal devices as mentioned above may be used not only as light modulators, but also as optical shutters, light switches and optical window shades. When combined with electro-optical devices, they can also be used for A/D converters and optical logic circuits.

(3) Measurement of Electro-Optical Properties

The liquid crystal panel is observed through a microscope of a crossed Nicols state and the desired drive voltage waveform is impressed on the liquid crystal panel using, for example, the arbitrary waveform generator AWG-2021 made by Sony/Tektronix Corporation. Then, the intensity of transmitted light in the state corresponding to each drive voltage waveform is detected through a photomultiplier. Output of this photomultiplier is loaded into the control circuit (computer) through a digital oscilloscope like the one made by Sony/Tektronix Corporation.

(4) Measurement of Internal DC Voltage

Measurement of internal DC voltage is performed as follows: the drive voltage waveform generated by an arbitrary waveform generator such as the BIOMATION Pragmatic 2202A from Toyo Corp. is impressed on the liquid crystal panel in the sealed box through, for example, the high voltage sample hold amplifier VHR-AMP01 made by Toyo Corp.

When the control voltage waveform synchronously generated from the waveform generator becomes off, the high voltage sample hold amplifier VHR-AMP01 detects the voltage between the "VG" terminal and "OUT" terminal with an open circuit voltage between the electrodes of the liquid crystal panel. The result of detection is loaded into the control circuit (computer) through an A/D converter or oscilloscope.

The sealed box is placed in the constant-temperature bath which enables measurement at a desired constant temperature (usually 40□). If the voltage waveform which is impressed just before open circuit operation is other than 0 V, electric charges by electrostatic (electronic) injection from the liquid crystal panel may affect measurement. Therefore, such component is removed by short-circuiting the electrodes (0 V) for a short time (e.g. 100 μsec), so that the internal DV voltage generated by ionic polarization, which is slower than relaxation of electrons, can be observed.

The internal DC voltage just before this short-circuiting cannot be directly measured because of the presence of electrostatically (electronically) injected charges. Hence, as shown in FIG. 8, inter-electrode voltages which change with time after short-circuit operation are plotted with a log scale and an internal DC voltage value can be obtained by extrapolation to time just after short-circuiting. When an arbitrary voltage waveform is continuously impressed for measurement, if the internal DC voltage accumulated by voltage impression is small, the object of measurement must be separated from the voltage induced by spontaneous polarization (hereinafter called Ps).

For the above reason, the result (Va) of measurement under normal conditions is combined with the result (Vb) obtained when 50 μsec reverse polarity voltage waveform for reversing the Ps state just before short-circuit operation is impressed, and the internal DC voltage generated by ionic polarization is calculated by the equation ((Va+Vb)/2) so that the voltage component induced by Ps can be eliminated.

To ensure uniformity in the initial state at each measurement for high repeatability in measurement, the object is heated for 10 minutes just before measuring until it becomes isotropic in a shorted state, and held, then cooled down to room temperature.

(5) Measurement of Transient Currents

Measurement of transient currents is made as follows: the drive voltage waveform generated by an arbitrary waveform generator such as the BIOMATION Pragmatic 2202A from Toyo Corp. is impressed on the liquid crystal panel in the sealed box through, for example, the voltage-current conversion amplifier Model 6250 from Toyo Corp.

The current-voltage conversion amplifier Model 6250 stops current detection when the control voltage waveform synchronously outputted from the waveform generator is turned on, and resumes current detection when the control voltage waveform is turned off. Taking advantage of this characteristic, the on-state of the control voltage waveform is synchronized with the area where the voltage of the drive voltage waveform impressed on the liquid crystal panel suddenly changes (typically, first 10 μsec then 50 μsec, or 60 μsec in total when the voltage change is stepped) so that relatively large rush current (electrostatically or electronically injected current component) can be removed. So, the current component to be measured, which is caused by impurity ion displacement and has a relatively small value, can be observed accurately.

Figure 11:
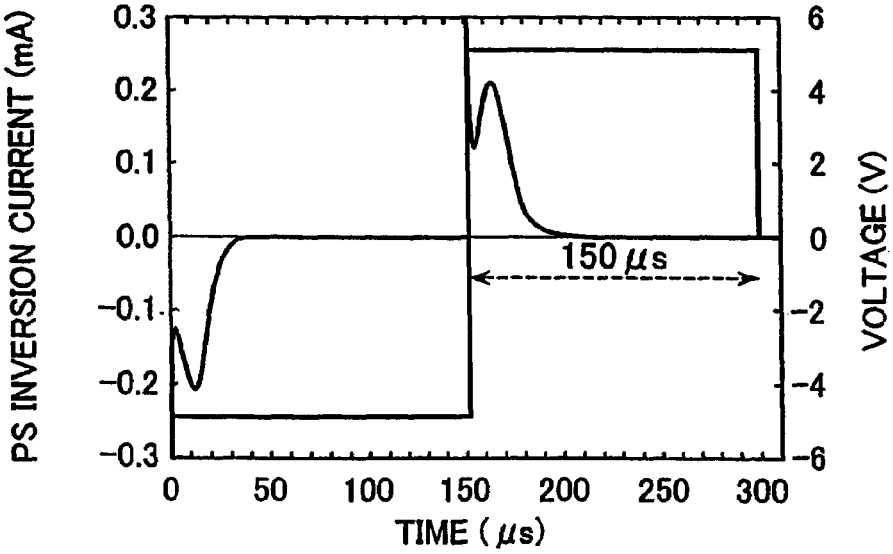
FIG. 11 is a graph showing Ps inversion current generated by Ps (spontaneous polarization) inversion in an SSFLC mode panel.
Figure 12:
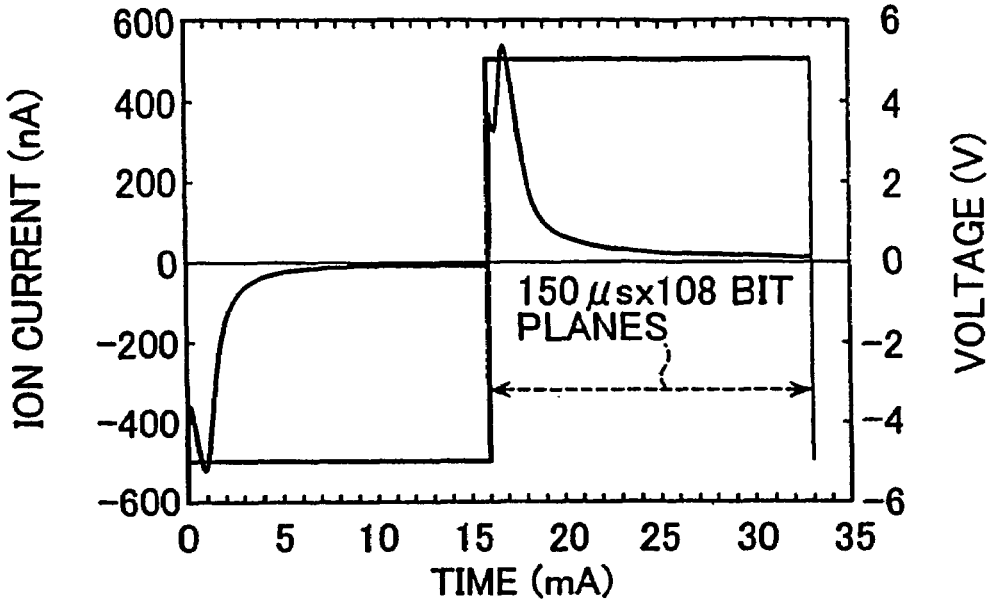
FIG. 12 is a graph showing Ps inversion current generated by Ps (spontaneous polarization) polarization in an SSFLC mode panel, wherein the observation time is longer than in the case of FIG. 11.

In an SSFLC panel, as shown in FIG. 11, Ps inversion current which occurs with Ps inversion can also be observed, which means that a change in liquid crystal orientation can be observed on a basis of currents. In this SSFLC mode, since the Ps inversion current is relatively large, the control voltage waveform should be lengthened up to the time when Ps inversion is completed, as shown in FIG. 12.

(6) Various Shapes of Waveform Constituting one Bit Plane According to the Present Invention FIGS. 13 through 17 show various drive voltage waveforms for one bit plane which selects one of the two states used in the LCD drive method according to the present invention. The waveforms (waveforms A through E) shown in FIGS. 13 through 17 assume that 1 bit plane corresponds to 154.3 μsec.

[1 Bit Plane Waveform A]

Waveform A (FIG. 13) uses a combination of positive voltage V1 (t1) and 0 V (t2) for selecting one state (on or off), and a combination of negative voltage V2 (t1) and 0 V (t2) for selecting the other state (off or on).

[1 Bit Plane Waveform B]

Waveform B (FIG. 14) uses only a fixed positive voltage V1 for selecting one state (on or off), and only a fixed negative voltage V2 for selecting the other state (off or on).

[1 Bit Plane Waveform C]

Waveform C (FIG. 15) uses a combination of positive voltages V1 and V3 (t1 and t2) for selecting one state (on or off), and a combination of negative voltages V2 and V4 (t1 and t2) for selecting the other state (off or on).

[1 BitPlane Waveform D]

Waveform D (FIG. 16) uses a combination of positive voltages V1, V3 and negative voltage V5 (t1, t2, t3) for selecting one state (on or off), and a combination of negative voltages V2, V4 and positive voltage V6 (t1, t2, t3) for selecting the other state (off or on), where the absolute values or durations of these voltages are not equal and internal DC voltage is effectively generated within the period of selection of one state.

[1 Bit Plane Waveform E]

Waveform E (FIG. 17) uses a combination of positive voltages V1, V3, negative voltage V5 and 0 V (t1, t2, t3, t4) for selecting one state (on or off), and a combination of negative voltages V2, V4, positive voltage V6 and 0 V (t1, t2, t3, t4) for selecting the other state (off or on), where the absolute values or durations of these positive and negative voltages are not equal and internal DC voltage is effectively generated within the period of selection of one state.

Figure 18:
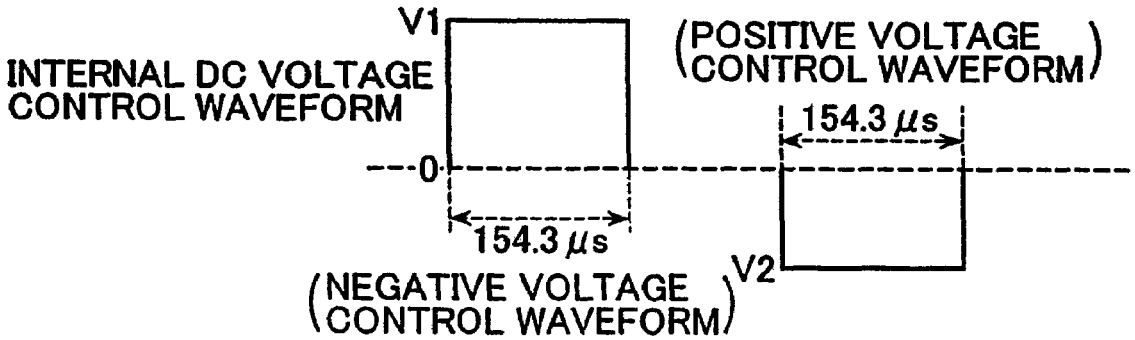
FIG. 18 is a timing diagram showing an internal DC voltage control waveform for the above-said LCD.

The voltage waveform for 1 bit plane for controlling internal DC voltage according to the present invention is as shown in FIG. 18: in the drive for selecting either the On or Off state, it is used for drive voltage waveform which effectively generates internal DC voltage in the selection period, and a waveform with reverse polarity which does not contribute to liquid crystal drive is inserted in a given period in order to control (reduce) the level of internal DC voltage. The voltage waveform shown in FIG. 18 is one example of voltage waveform for controlling internal DC voltage in the LCD drive method according to the present invention. This is opposite in polarity to the waveform B in FIG. 14.

The voltage waveform for controlling internal DC voltage is not limited to the one shown in FIG. 18. It is also possible to use a voltage waveform which has the same shape as that of the waveform for selecting one state in waveform A (FIG. 13), C (FIG. 15), D (FIG. 16) or E (FIG. 17) and is opposite in polarity to the effective internal DC voltage which is generated in the period of selection of ones state. If that is the case, all required waveforms are prepared by a combination of only two types of 1-bit-plane waveforms, reducing the load on the waveform generator circuit and device.

From another point of view, 1-bit-plane waveforms shown in FIGS. 13 through 17 (waveforms A through E) may be combined in different ways or a plurality of such waveforms may be combined in order to reduce internal DC voltage more effectively, though the load on the waveform generator circuit or device increases.

Figure 13:
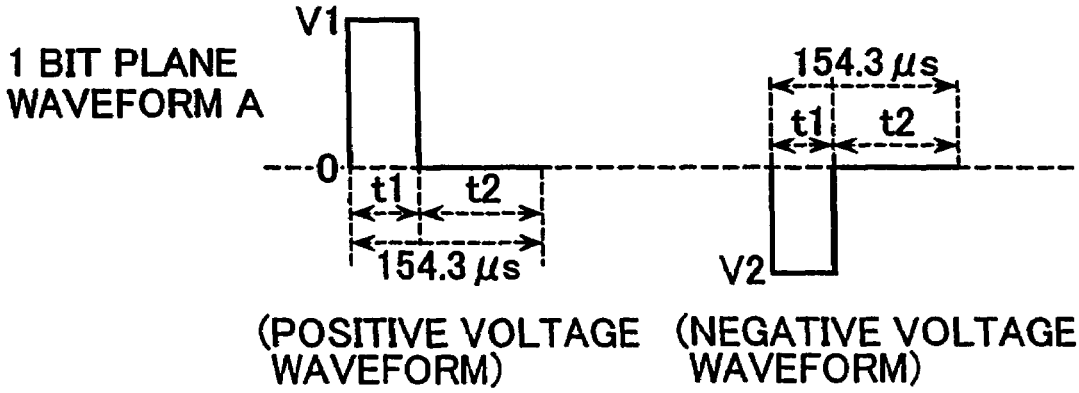
FIG. 13 is a timing diagram showing an example of bit plane waveform (waveform A) for the above-said LCD.
Figure 16:
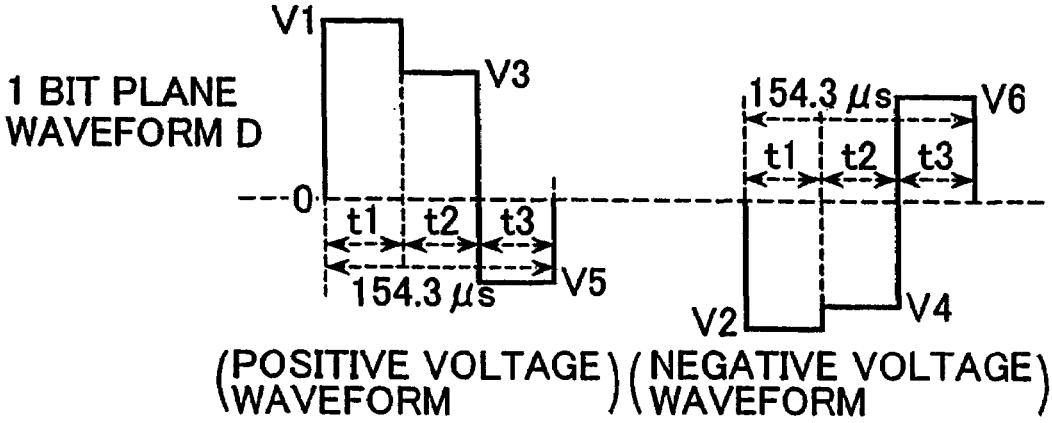
FIG. 16 is a timing diagram showing an example of bit plane waveform (waveform D) for the above-said LCD.
Figure 17:
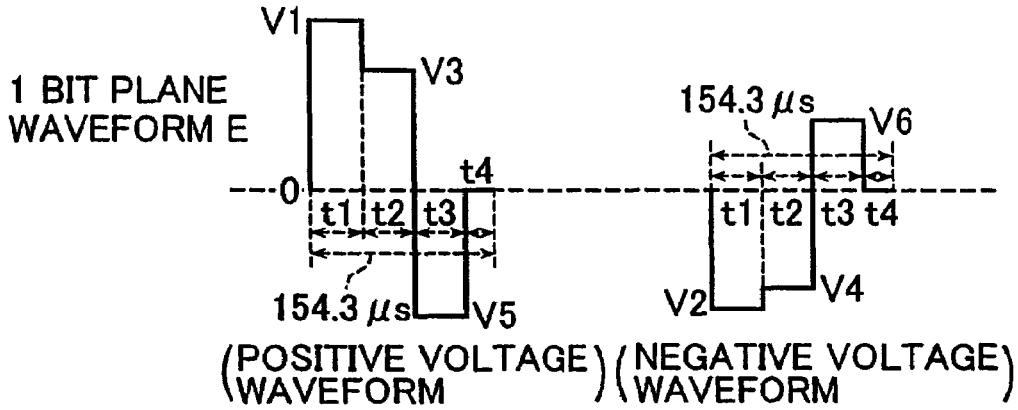
FIG. 17 is a timing diagram showing an example of bit plane waveform (waveform E) for the above-said LCD.

The major feature of the voltage waveform for controlling internal DC voltage according to the present invention, which uses one bit plane or uses a succession of bit planes, is that it is DC voltage waveform whose polarity is reverse to that of the effective internal DC voltage which is generated in the period of selection of one state, or in case of waveforms A, D and E shown in FIGS. 13, 16 and 17, a virtual DC voltage waveform with reverse polarity on the time average.

Figure 14:
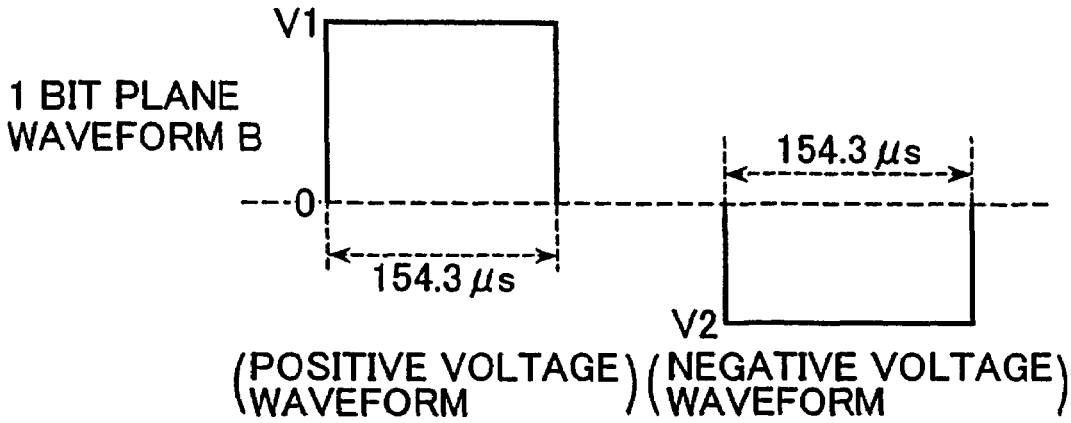
FIG. 14 is a timing diagram showing an example of bit plane waveform (waveform B) for the above-said LCD.
Figure 15:
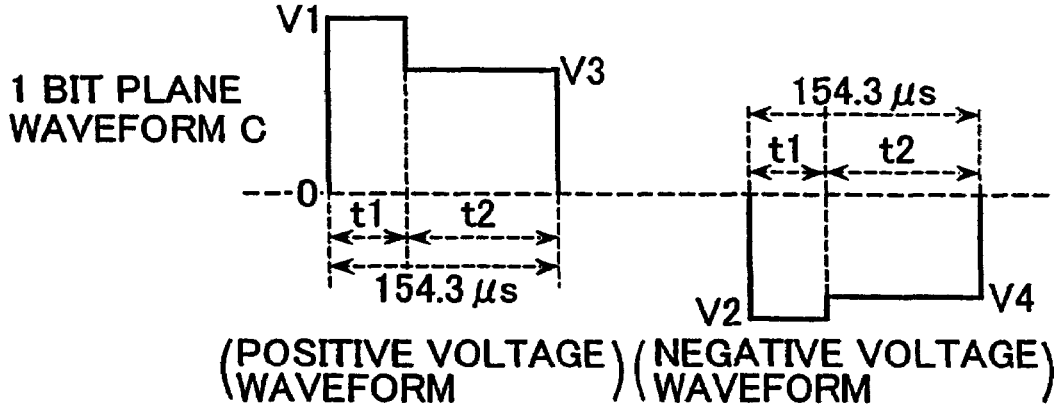
FIG. 15 is a timing diagram showing an example of bit plane waveform (waveform C) for the above-said LCD.

(7) Examples of Insertion of Internal DC Voltage Control Waveforms According to the Present Invention Even when the voltage waveforms for 1 bit plane are waveforms C, D and E in FIGS. 15, 16 and 17, they can be considered as equivalent to waveform B in FIG. 14 if they are time-averaged. Therefore, control of internal DC voltage can be done by inserting waveform B (FIG. 14) and internal DC voltage control waveform (FIG. 18) into waveforms C, D and E, as explained below. While this control voltage waveform is being impressed, LEDs or other illumination is turned off so that no display is made.

[Drive Voltage Waveform 1]

Figure 19A:
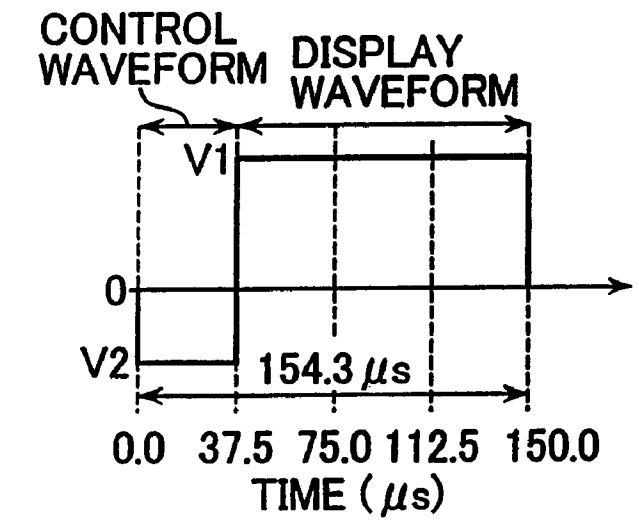
FIG. 19 is a timing diagram showing "drive waveform 1" for the above-said LCD in which a control voltage waveform is inserted into the voltage waveform for one bit plane.
Figure 19B:
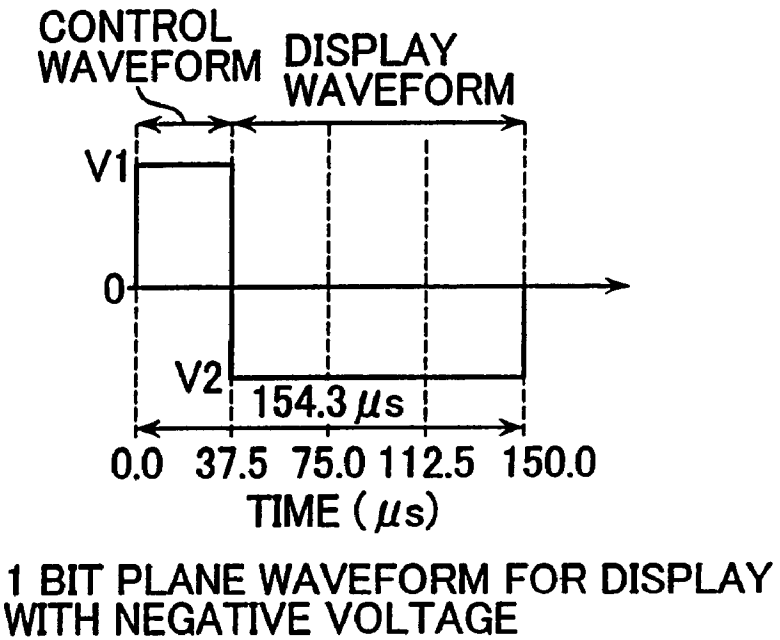

As shown in FIG. 19, in this example, control voltage waveform is inserted into a voltage waveform constituting 1 bit plane.

Assuming that parameters for waveform E in FIG. 17 are V2=V4, V1=V3, t1=t2=37.5 μsec, and t3=112.5 μsec, it can be thought that the initial 25% of one bit plane is a waveform period for controlling internal DC voltage, and the remaining waveform period is dedicated to selection of one state for the liquid crystal.

Here, it is assumed that drive voltage waveform 1 consists of a succession of 108 bit planes of waveforms, where each bit plane comprises a positive voltage for liquid crystal state selection waveform period and a negative voltage for control voltage waveform period.

[Drive Voltage Waveform 2]

Figure 20:
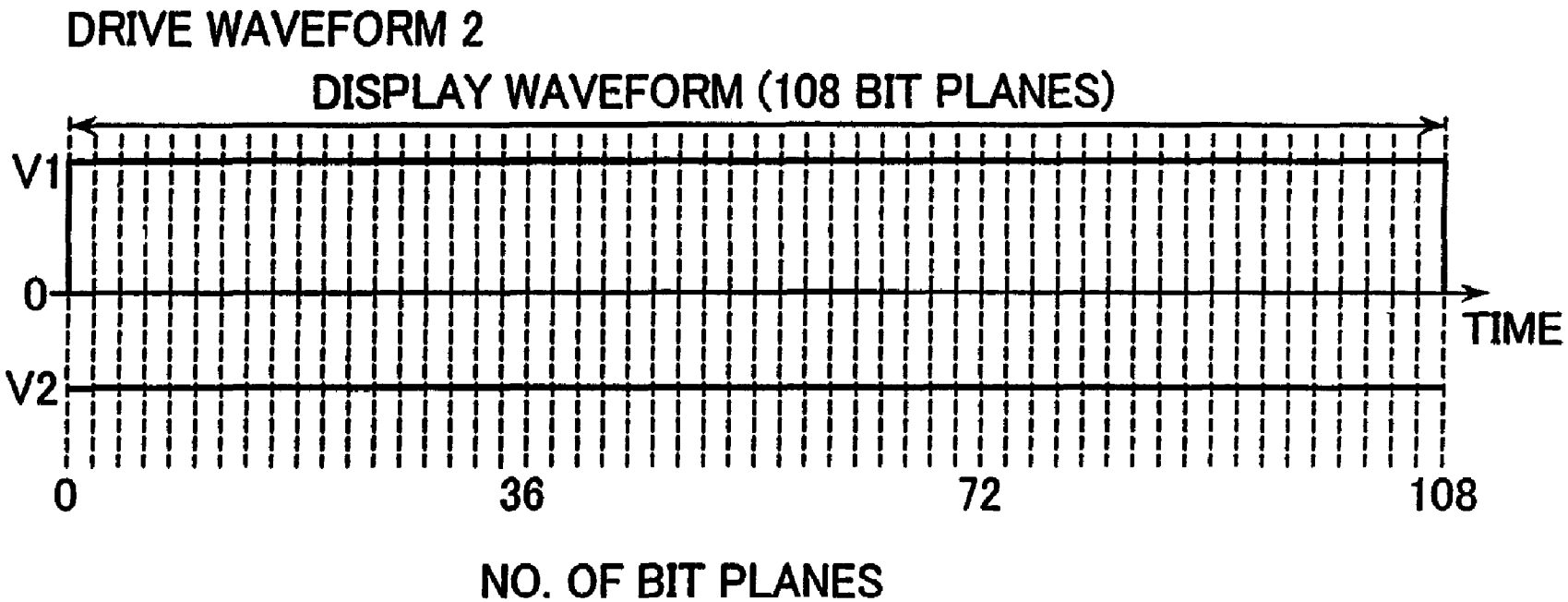
FIG. 20 is a timing diagram showing drive voltage waveform 2 for the above-said LCD in which one frame consists of 108 bit planes and no internal DC voltage control waveform is inserted.

As shown in FIG. 20, in this example, one frame consists of 108 bit planes and no internal DC voltage control waveform is inserted.

[Drive Voltage Waveform 3]

Figure 21:
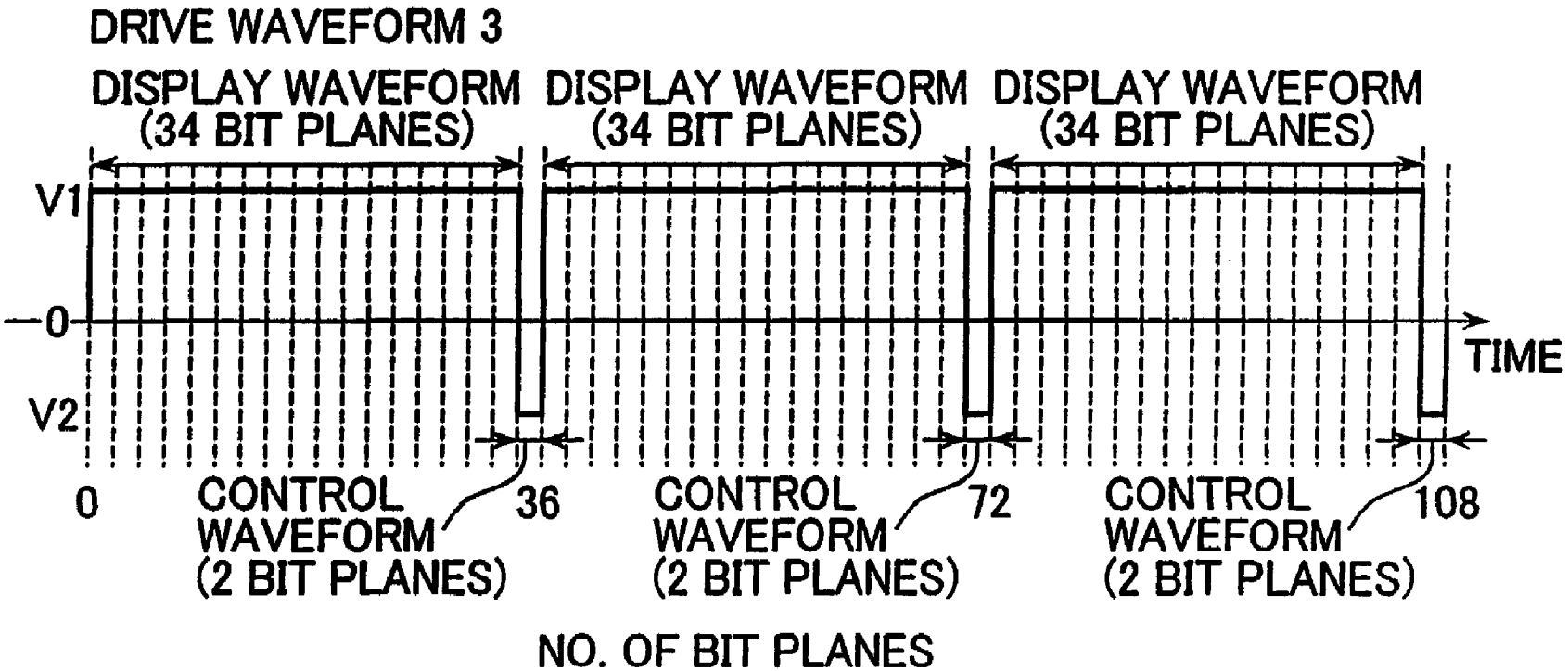
FIG. 21 is a timing diagram showing drive voltage waveform 3 for the above-said LCD in which one frame consists of 108 bit planes and 2 bit planes of internal DC voltage control waveform (6 in total) are inserted every 36 bit planes.

As shown in FIG. 21, in this example, one frame consists of 108 bit planes and there are 2 bit planes for internal DC voltage control waveform inserted every 36 bit planes, i.e. a total of 6 such bit planes.

[Drive Voltage Waveform 4]

Figure 22:
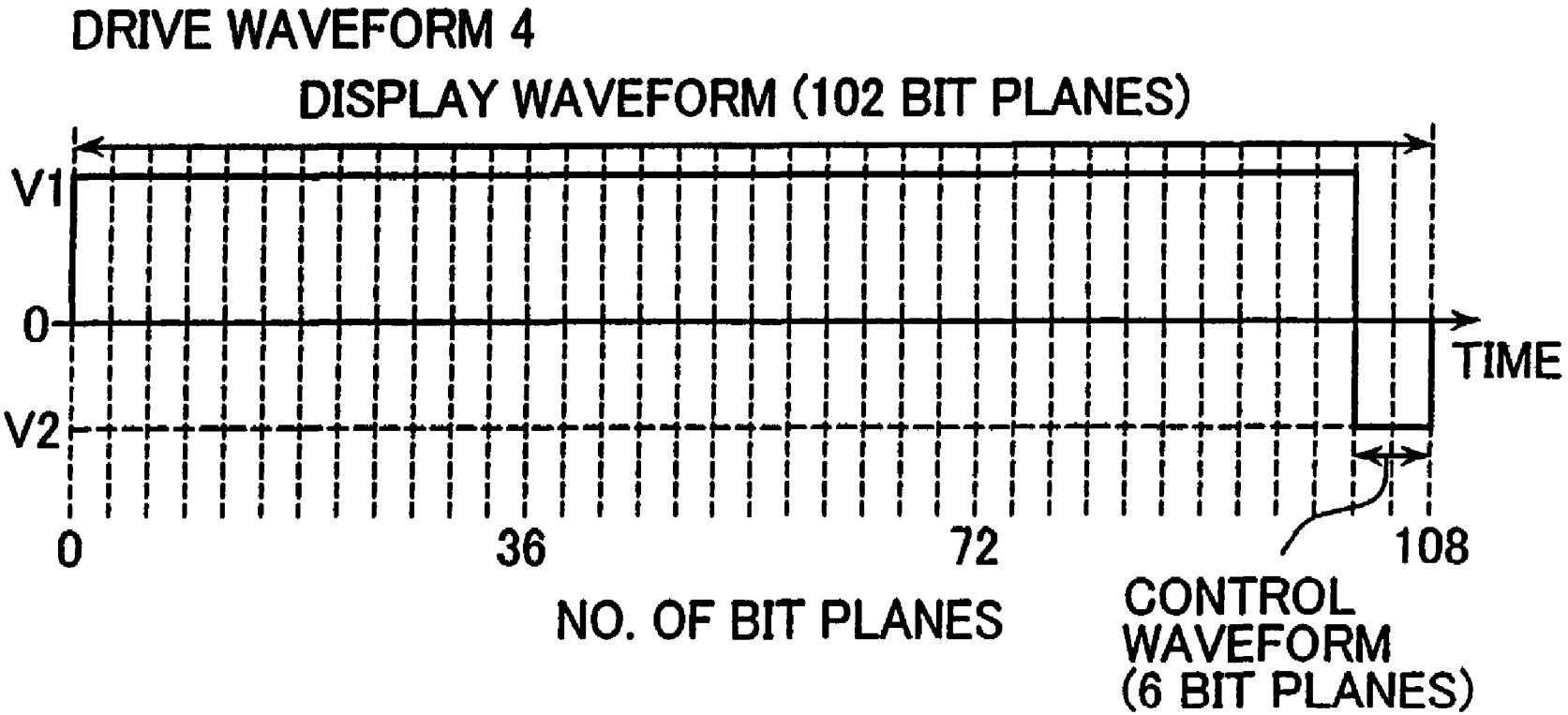
FIG. 22 is a timing diagram showing drive voltage waveform 4 for the above-said LCD in which one frame consists of 108 bit planes and a succession of 6 bit planes of internal DC voltage control waveform are inserted.
Figure 23A:
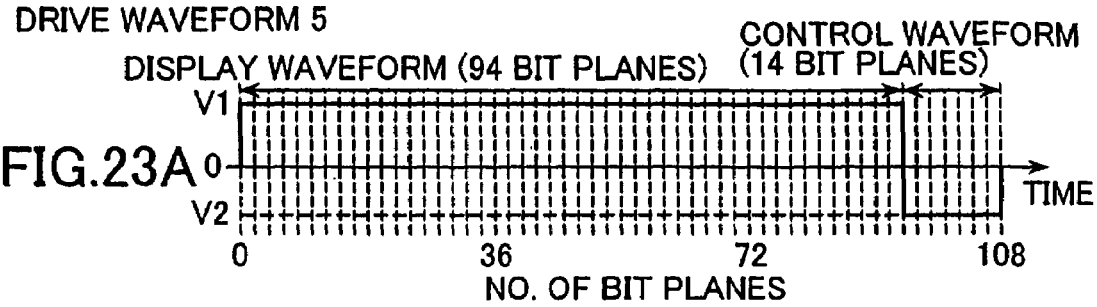
FIGS. 23A through 23E are timing diagrams showing drive voltage waveforms 5 through 9 for the above-said LCD in which one frame consists of 108 bit planes and 14 (FIG. 23A), 24 (FIG. 23B), 36 (FIG. 23C), 44 (FIG. 23D) and 52 (FIG. 23E) bit planes of internal DC voltage control waveform are inserted, respectively.
Figure 23B:
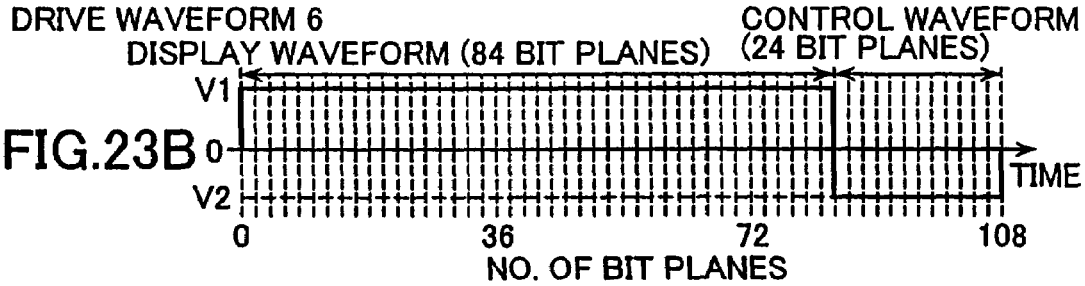
Figure 23C:
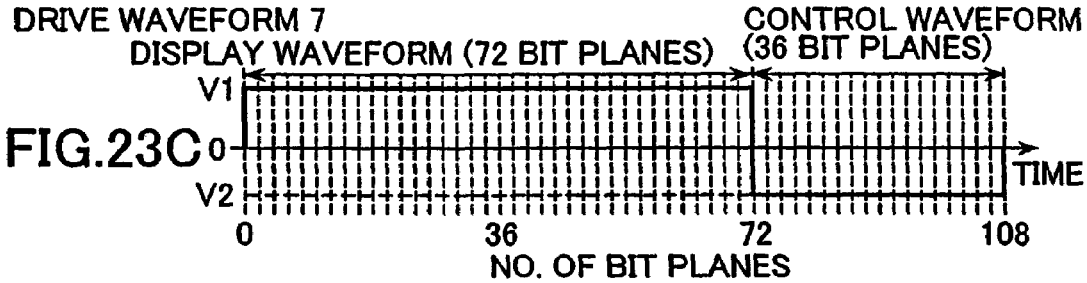
Figure 23D:
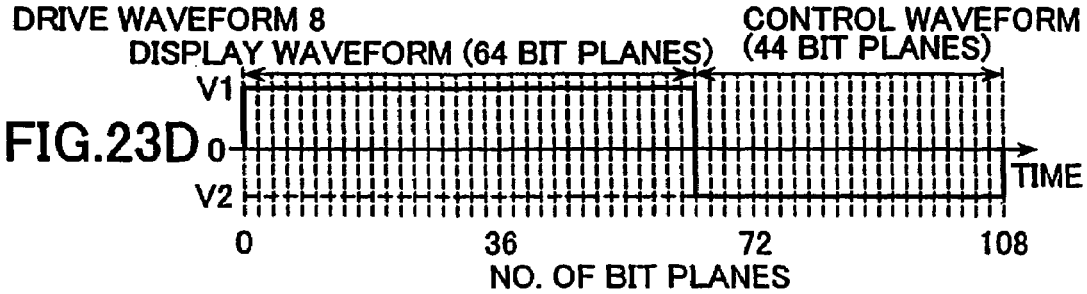
Figure 23E:
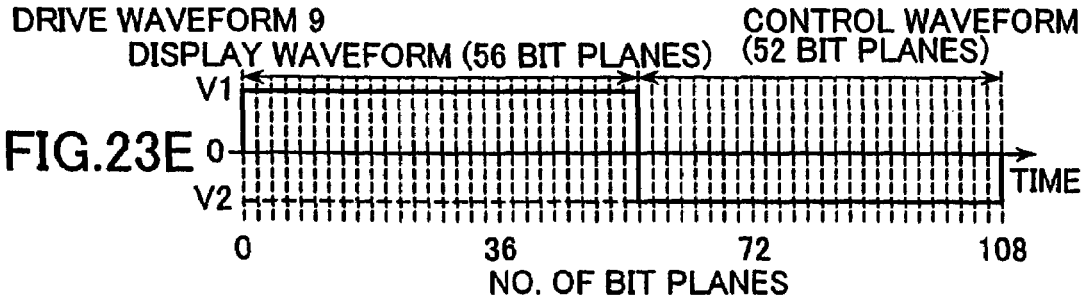

As shown in FIG. 22, in this example, one frame consists of 108 bit planes and 6 successive bit planes for internal DC voltage control waveform are inserted. In this example, the ratio of the waveform period for liquid crystal state selection to that for internal DC voltage control is the same as the ratio for "drive voltage waveform 3" mentioned above.

[Drive Voltage Waveforms 5 through 9]

As shown in FIGS. 23A through 23E, in these examples, one frame consists of 108 bit planes and 14, 24, 36, 44 and 52 bit planes for control voltage waveform are inserted, respectively. The durations of these control voltage waveform periods are approx. 2.16 msec, 3.70 msec, 5.55 msec, 6.79 msec, and 8.02 msec, respectively, which account for 13%, 22%, 33%, 41% and 48% of the whole waveform, respectively. For comparison, this percentage for drive voltage waveform 4, which has 6 such bit planes, is 5.6%.

[Drive Voltage Waveforms 10 through 12]

Figure 24A:
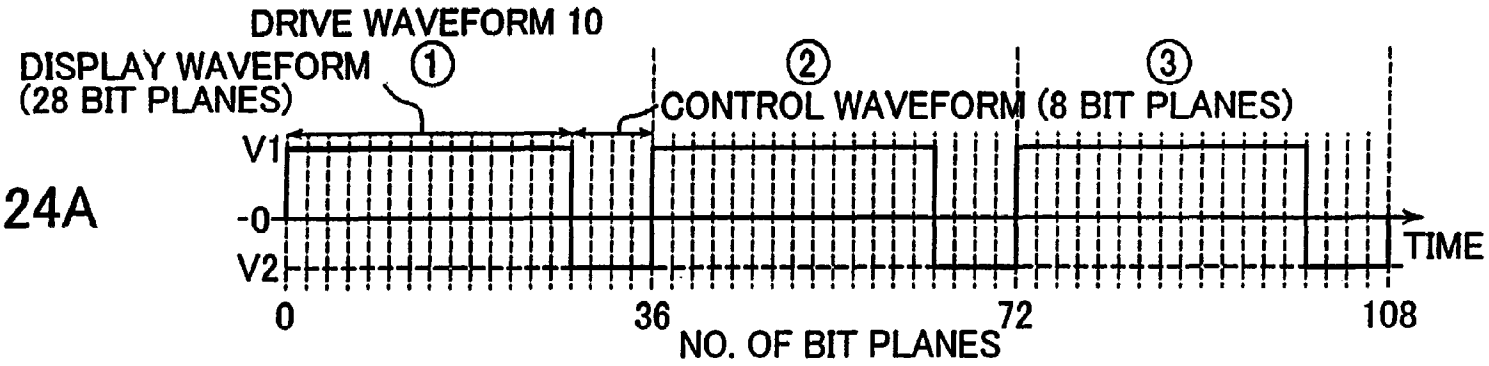
FIGS. 24A through 24C are timing diagrams showing drive voltage waveforms 10 through 12 for the above-said LCD in which one frame consists of 108 bit planes and a total of 24 bit planes of internal DC voltage control waveform are inserted and divided into 3, 6 and 12 parts over the 108 bit planes.
Figure 24B:
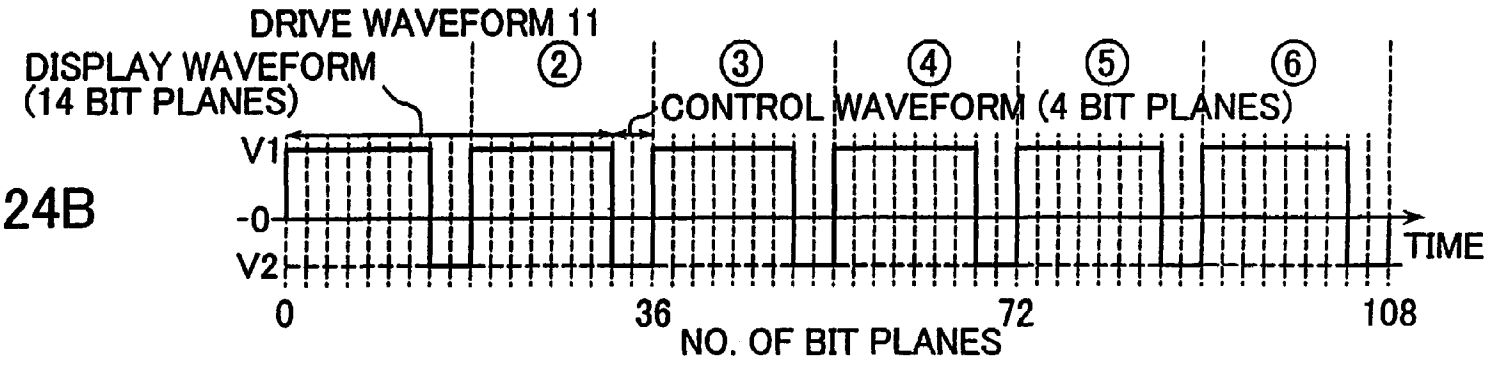
Figure 24C:
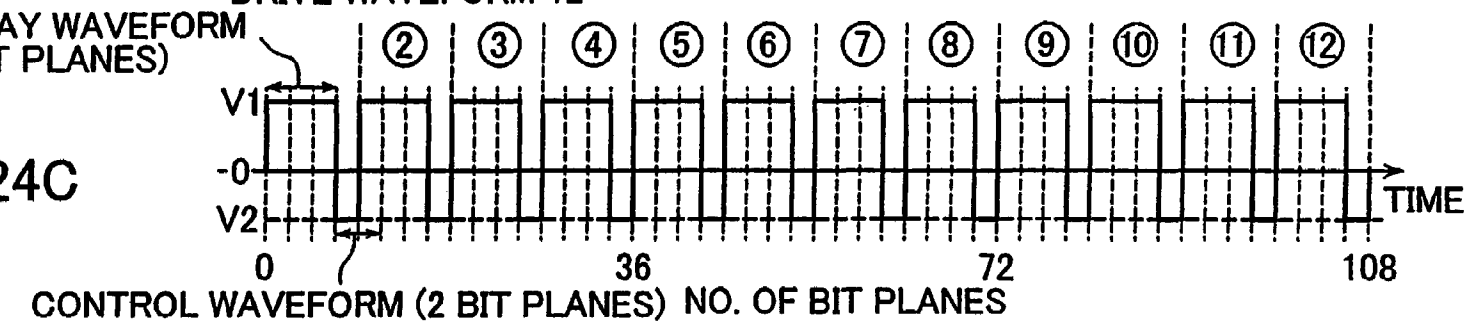

As shown in FIGS. 24A through 24C, in these examples, one frame consists of 108 bit planes and a total of 24 bit planes for control voltage waveform are inserted (control voltage waveform duration: 3.70 msec; ratio to the whole waveform: 22%). These 24 bit planes are equally divided into 3, 6 and 12 parts over the 108 bit planes.

[Drive Voltage Waveforms 13 through 19]

In the above-said drive voltage waveforms 1 through 12, a negative voltage waveform is used as a control voltage waveform to reduce the internal DC voltage generated by one frame or successive frames for one of the two liquid crystal states selected with a positive voltage in the display-related drive voltage waveform period. This means that, in the display-related voltage waveform period, a negative voltage is applied for the voltage waveform period to control internal DC voltage which is accumulated with the impression of a positive voltage.

We will discuss below the process to see whether application of reverse polarity voltage waveform to control internal DC voltage is effective or not, even if the display-related voltage waveform period is not completely positive in waveform. Described below for this purpose are the results of impression of negative voltage to control internal DC voltage with different ratios of positive to negative voltage waveforms for the display-related voltage waveform period, ranging from the condition in which one state is selected only with a positive voltage to the condition in which the applied waveform is electrically neutral with no internal DC voltage accumulation.

FIGS. 25A through 25D show that, like the above-said drive voltage waveform 7 where one frame consists of 108 bit planes, if 36 bit planes (duration 5.55 msec, ratio to the whole waveform 33%) are used for control voltage waveform, 72 bit planes are used for display. Here, while a negative voltage waveform is applied for 36 bit planes of control voltage waveform, the ratio of positive voltage waveform against the waveform dedicated to display (72 bit planes) is varied as follows: 63/72 (87.5%), 54/72 (75%), 45/72 (62.5%), and 36/72 (50%).

Figure 25A:
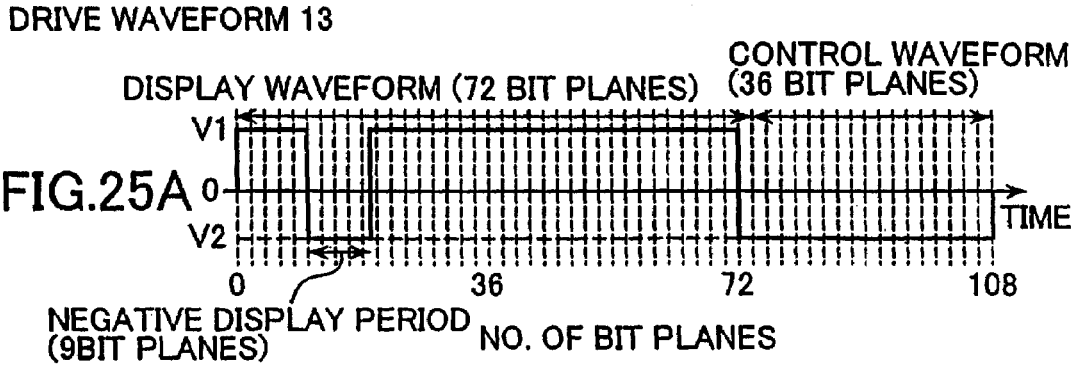
FIGS. 25A through 25D are timing diagrams showing drive voltage waveforms 13 through 16 for the above-said LCD in which one frame consists of 108 bit planes, 36 bit planes are used for control voltage waveform and 72 bit planes for display, with the ratio of positive voltage waveform in the display-related waveform period (72 bit planes) being 63/72 (87.5%), 54/72 (75%), 45/72 (62.5%), and 36/72 (50%), respectively and the 36 bit planes of control voltage waveform being negative voltage waveform.
Figure 25B:
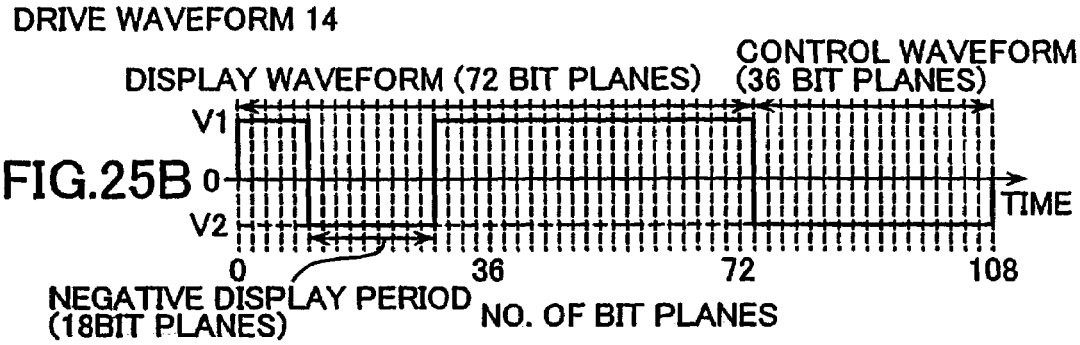
Figure 25C:
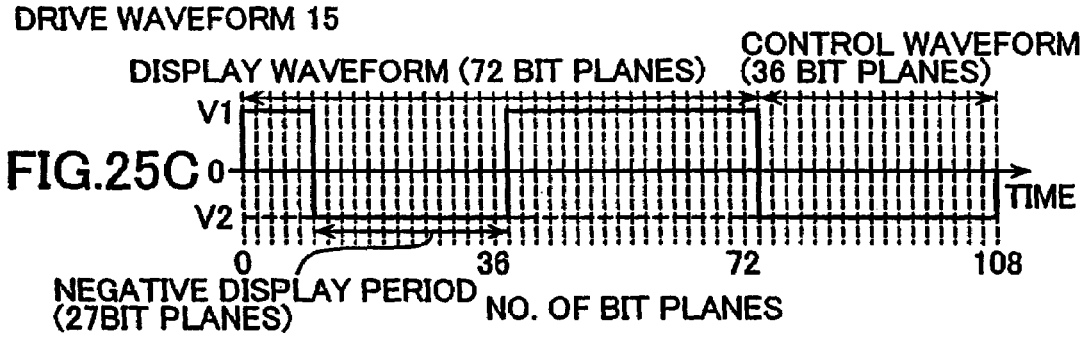
Figure 25D:
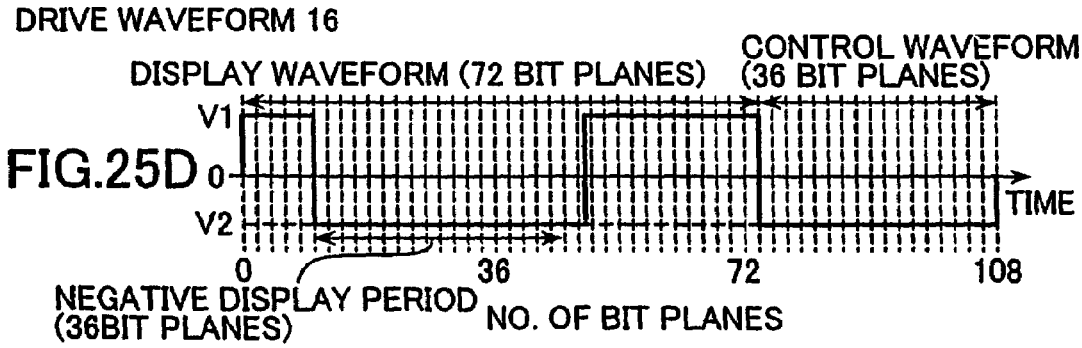
Figure 25E:
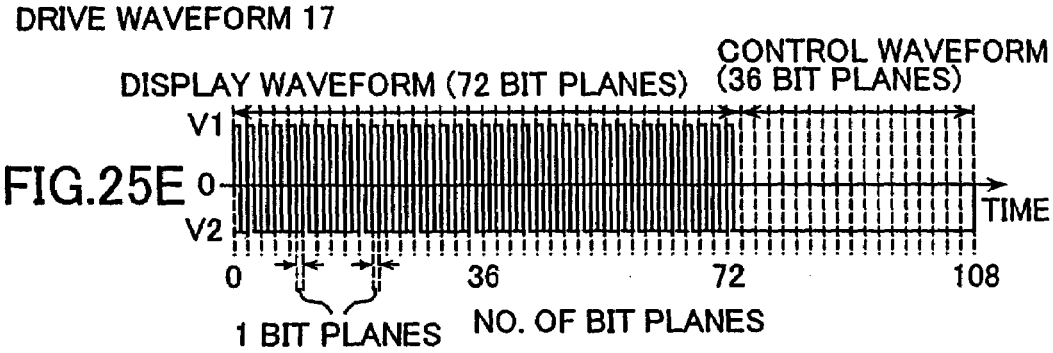
FIGS. 25E through 25G are timing diagrams showing drive voltage waveforms 17 through 19 for the above-said LCD in which one frame consists of 108 bit planes, 36 bit planes are used for control voltage waveform and 72 bit planes for display, and the ratio of positive voltage waveform in the display-related waveform period is 36/72 (50%), with a positive voltage waveform and a negative one being repeated alternately throughout the display-related waveform period (72 bit planes) every bit plane, every three bit planes, and every six bit planes respectively.
Figure 25F:
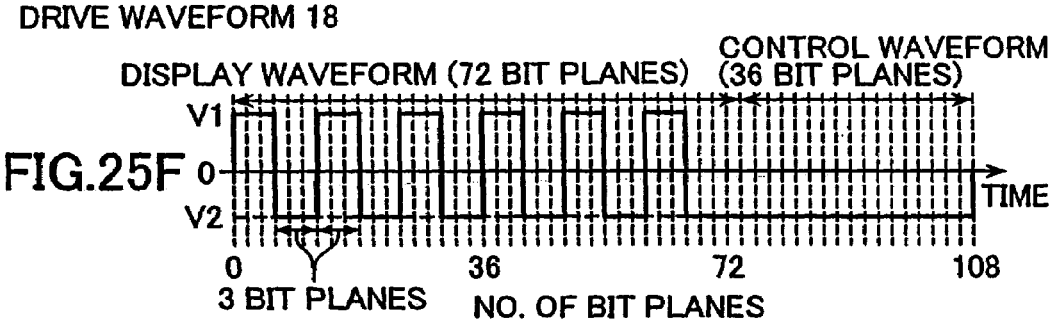
Figure 25G:
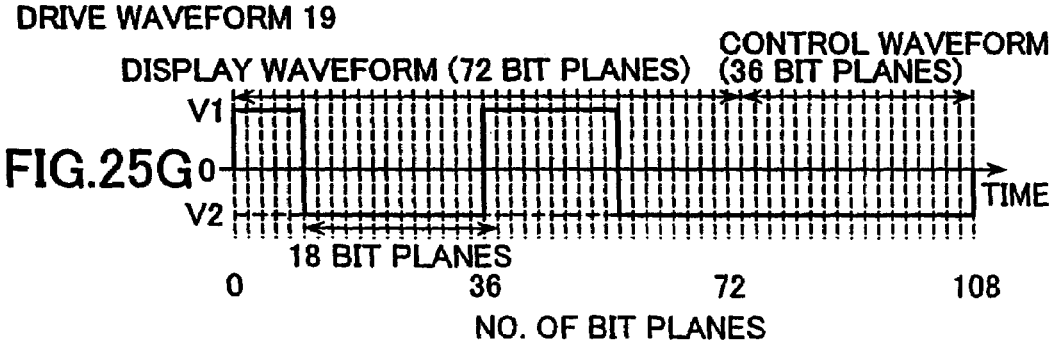

Further, we will examine the following cases (FIGS. 25E through 25G) in which different frequencies of negative voltage waveform insertion for internal DC voltage control are used: on the assumption that the ratio of positive voltage waveform in the display-related waveform period is 36/72 (50%), a positive voltage waveform and a negative one are repeated alternately throughout the display-related waveform period (72 bit planes) every bit plane in the case of FIG. 25E, every three bit planes in the case of FIG. 25F, and every six bit planes in the case of FIG. 25G.

In these cases, if the positive and negative components of the drive voltage waveform amplitude are symmetric to each other, i.e. (|V1|=|V2|), it is desirable to impress 0 V DC voltage in the control period because no internal DC voltage accumulation occurs in the display-related period. However, if 0 V should be generated in addition to positive and negative voltages in the internal DC voltage control waveform period, a more complicated circuit for selecting the most suitable waveform from the three choices and dealing with output thereof would be needed. So, for the sake of simplification, there may be a situation in which logically the control waveform should be negative or positive even if no internal DC voltage accumulation occurs in the display-related waveform period. In this situation, internal DC voltage might be generated in the control voltage waveform period which is primarily intended to reduce internal DC voltage, as shown in FIG. 25A through FIG. 25G.

However, as it is apparent from the results stated later, in such a situation, the voltage waveform in the display-related period is such that no internal DC voltage accumulation occurs, which implies that the internal DC voltage which may be generated during the control period can be controlled in the display-related period.

Next is a typical example of waveform based on the bistable memory of SSFLC which is 1 bit plane waveform A as shown in FIG. 13.

When the waveform shown in FIG. 13 for selecting two liquid crystal states and the internal DC voltage control waveform shown in FIGS. 13 and 14 are mainly used, the effect of insertion of internal DC voltage control waveform will be discussed below. While the control voltage waveform is being applied, LEDs or other illumination is turned off so that no display is made.

[Drive Voltage Waveform 20]

Figure 26:
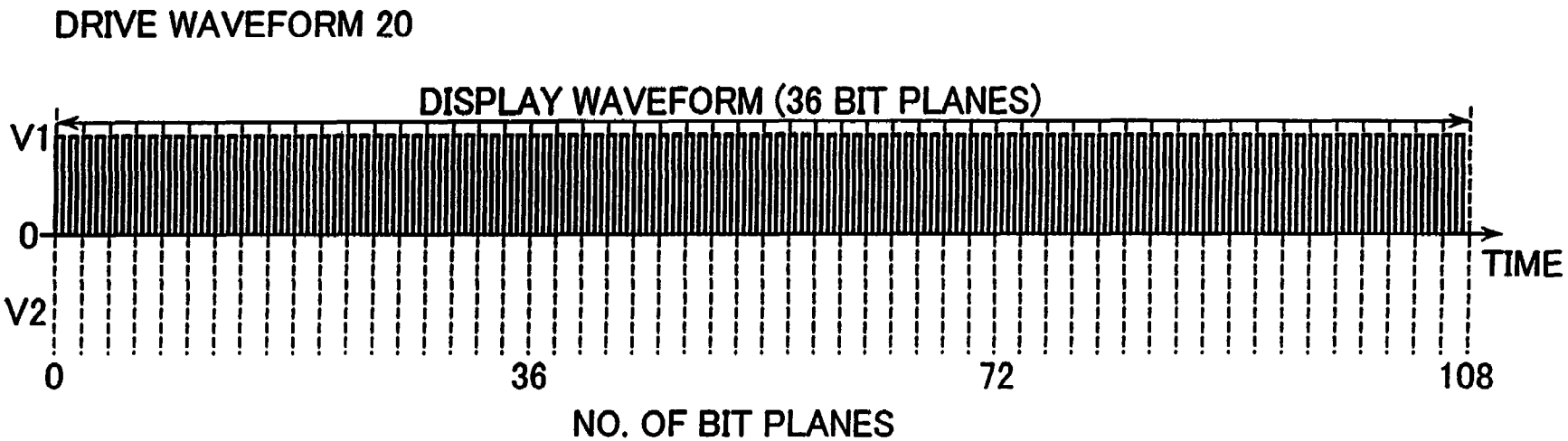
FIG. 26 is a timing diagram showing drive voltage waveform 20 for the above-said LCD in which one frame consists of 108 bit planes and no internal DC voltage control waveform is inserted.

As shown in FIG. 26, in this example, one frame consists of 108 bit planes and no internal DC voltage control waveform is inserted.

[Drive Voltage Waveform 21]

Figure 27:
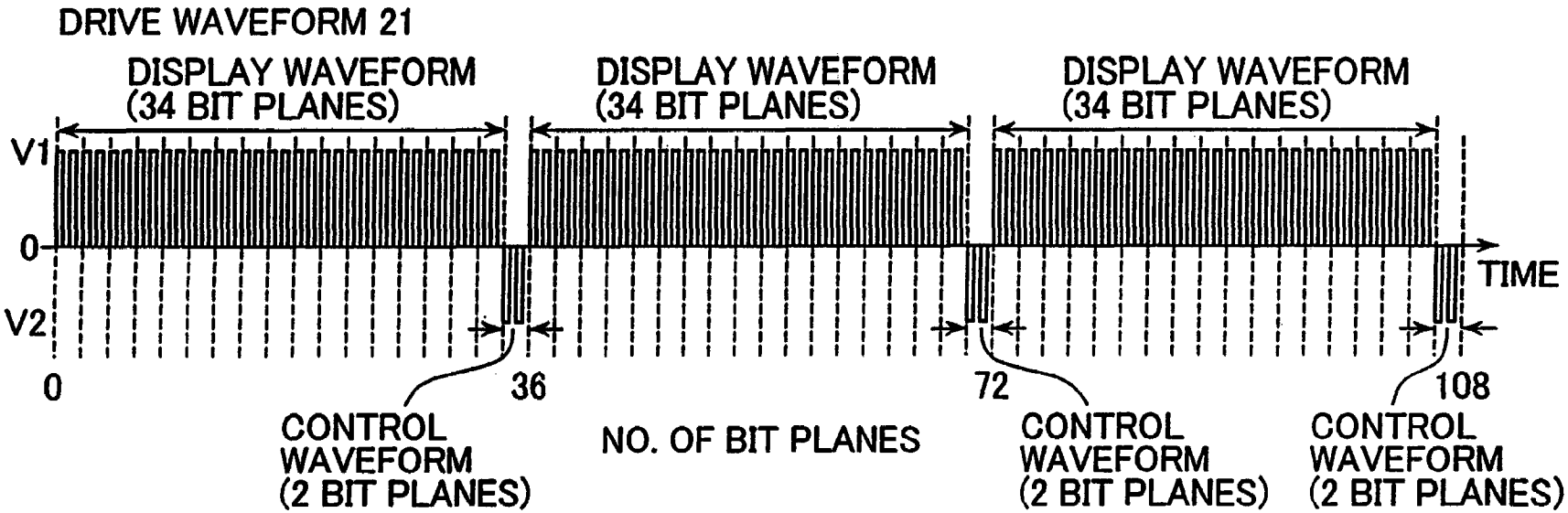
FIG. 27 is a timing diagram showing drive voltage waveform 21 for the above-said LCD in which one frame consists of 108 bit planes and there are 2 bit planes of internal DC voltage control waveform inserted every 36 bit planes, i.e. a total of 6 bit planes of voltage control waveform.

As shown in FIG. 27, in this example, one frame consists of 108 bit planes and there are 2 bit planes for internal DC voltage control waveform inserted every 36 bit planes, i.e. a total of 6 such bit planes.

[Drive Voltage Waveform 22]

Figure 28:
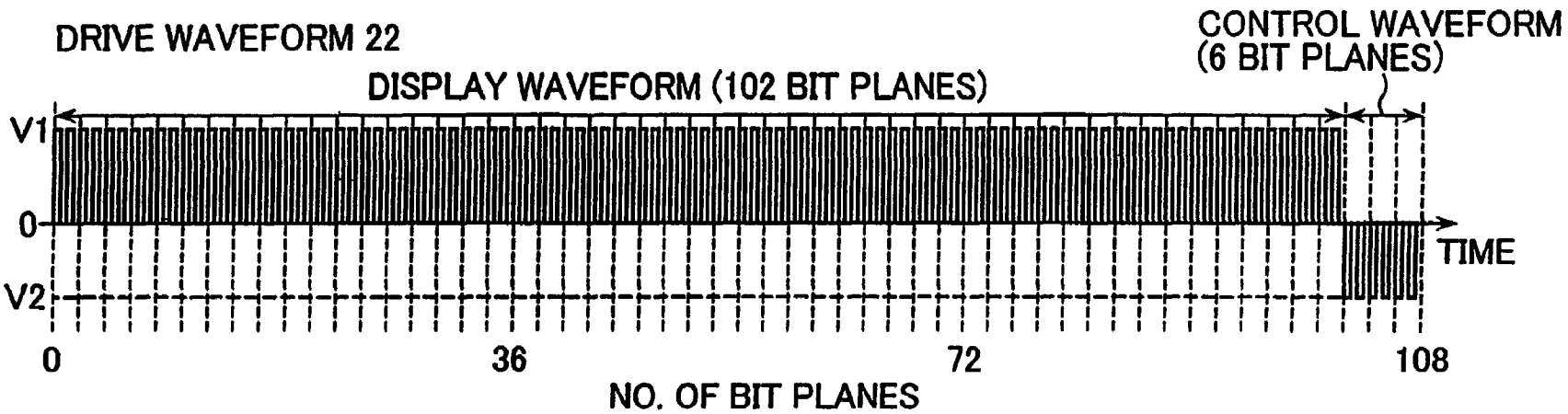
FIG. 28 is a timing diagram showing drive voltage waveform 22 for the above-said LCD in which one frame consists of 108 bit planes and 6 successive bit planes of internal DC voltage control waveform are inserted.
Figure 29A:
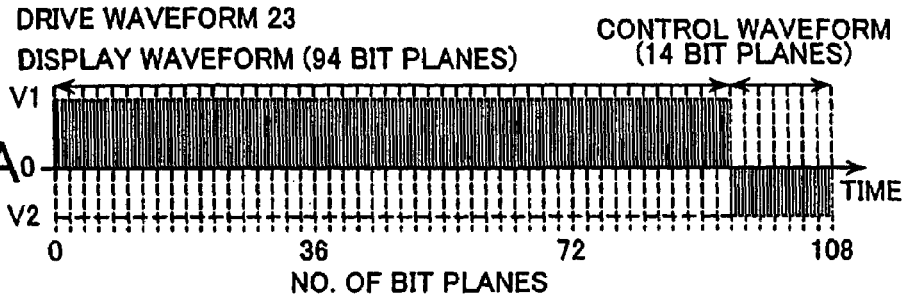
FIGS. 29A through 29E are timing diagrams showing drive voltage waveforms 23 through 27 for the above-said LCD in which one frame consists of 108 bit planes and 14, 24, 36, 44 and 52 bit planes of internal DC voltage control waveform are inserted, respectively.
Figure 29B:
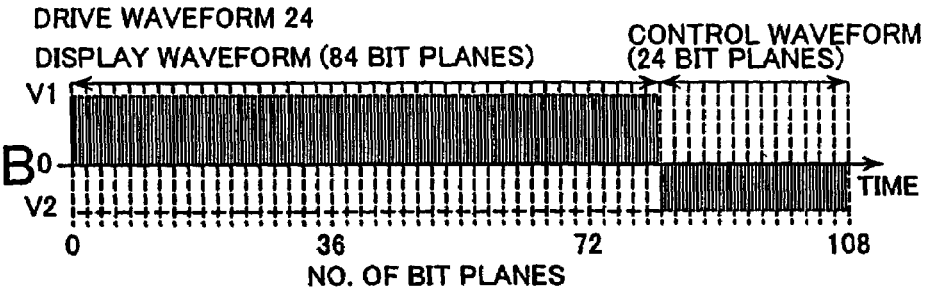
Figure 29C:
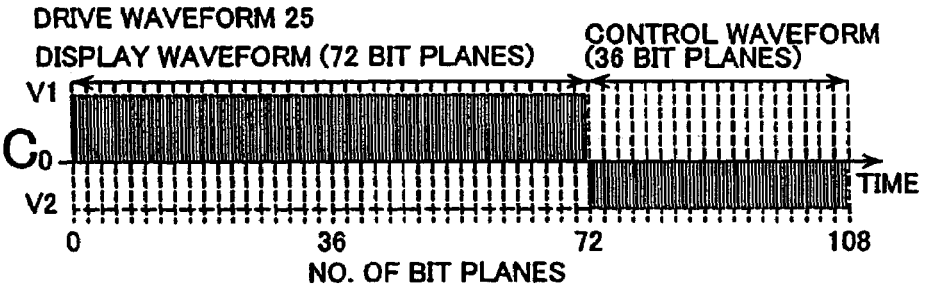
Figure 29D:
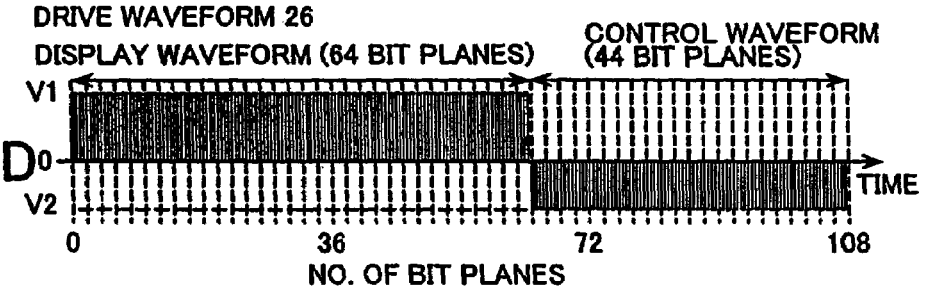
Figure 29E:
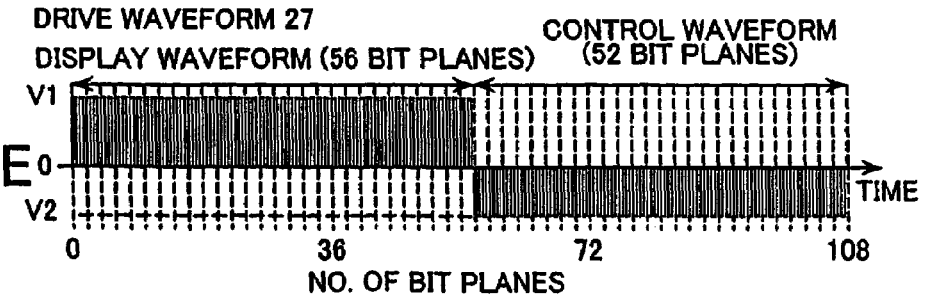

As shown in FIG. 28, in this example, one frame consists of 108 bit planes and 6 successive bit planes for the control voltage waveform are inserted. In this example, the ratio of the waveform period for selection of one liquid crystal state to that for internal DC voltage control is the same as the ratio for "drive voltage waveform 21" shown in FIG. 27.

[Drive Voltage Waveforms 23 through 27]

As shown in FIGS. 29A through 29E, in these examples, one frame consists of 108 bit planes and 14, 24, 36, 44 and 52 bit planes for the control voltage waveform are inserted, respectively. The durations of these control voltage waveform periods are approx. 2.16 msec, 3.70 msec, 5.55 msec, 6.79 msec, and 8.02 msec, respectively, which account for 13%, 22%, 33%, 41% and 48% of the whole waveform, respectively. For comparison, this percentage for drive voltage waveform 22 shown in FIG. 28, which such bit planes, is 5.6%.

[Drive Voltage Waveforms 28 through 30]

Figure 30A:
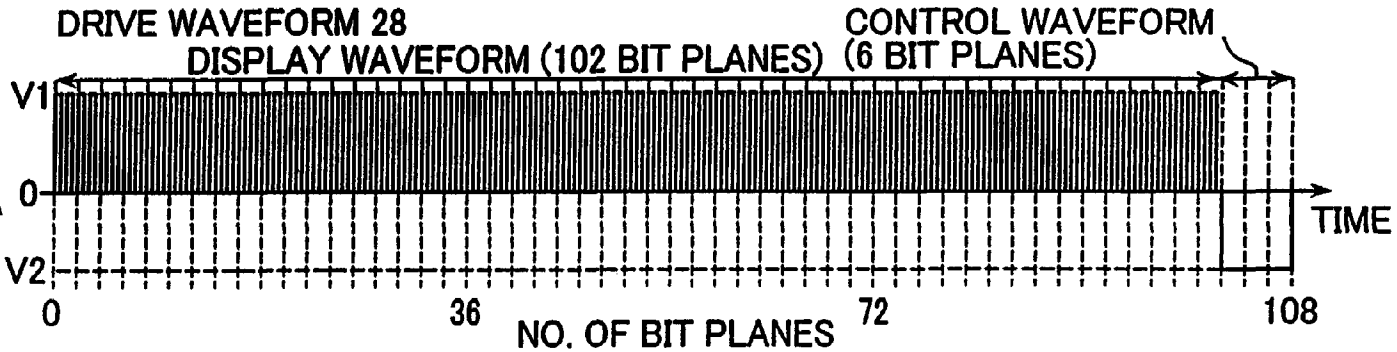
FIGS. 30A though 30C are timing diagrams showing drive voltage waveforms 28 through 30 for the above-said LCD in which one frame consists of 108 bit planes and 14, 24, and 36 successive bit planes of internal DC voltage control waveform shown in FIG. 14 and FIG. 18 are inserted, respectively.
Figure 30B:
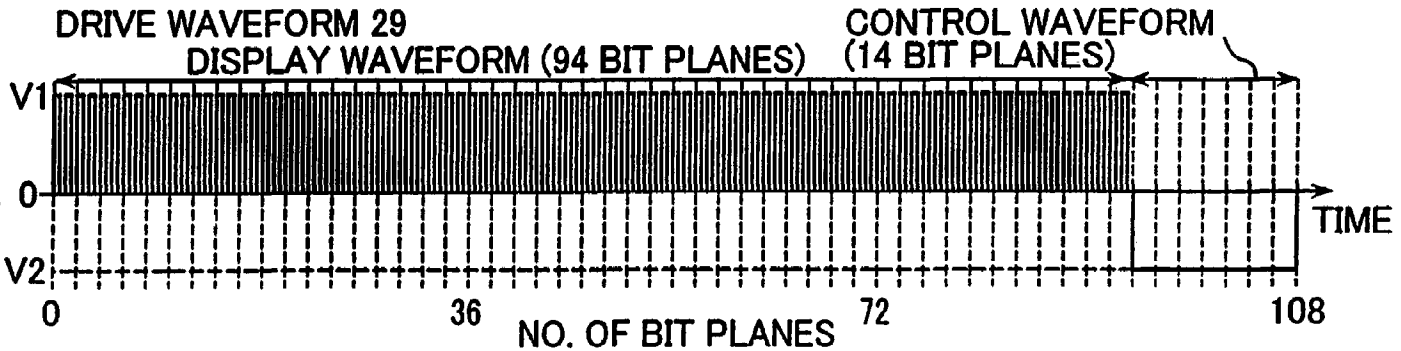
Figure 30C:
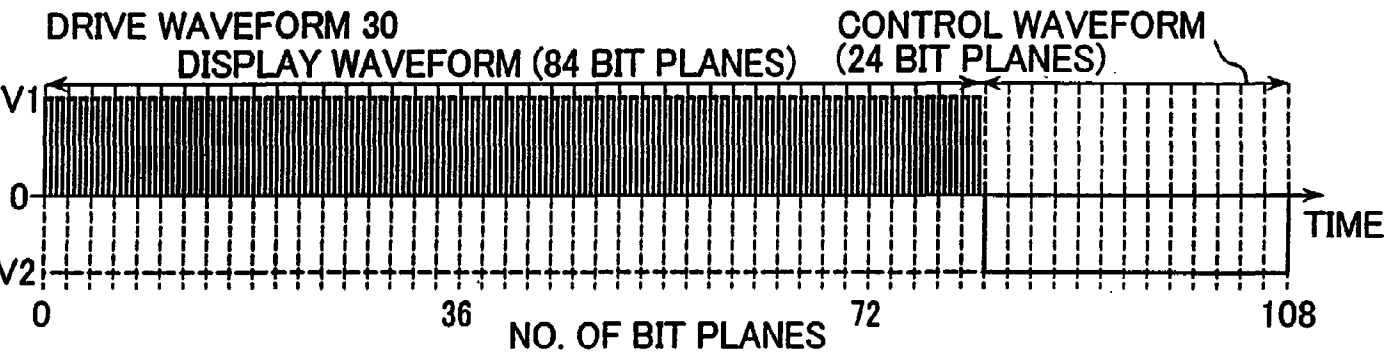

As shown in FIGS. 30A through 30C, in these examples, one frame consists of 108 bit planes and 14, 24, and 36 successive bit planes for the control voltage waveform shown in FIG. 18 and FIG. 14 are inserted, respectively.

(8) Effective DC Voltage per Unit Time for the Drive Voltage Waveforms Used in the Present Invention For the above-said drive voltage waveforms 1 through 30, the positive and negative impressed voltages are intentionally asymmetric to each other so it can be said that the DC voltage here is virtual.

Tables 1 through 3 and 4 through 6 show the effective DC voltage component per unit time as calculated based on drive voltages indicated next.

TABLE 1

| Embodiment No. | Drive waveform | Display/ selection waveform voltage | Internal DC voltage control waveform | Effective DC voltage | Effective DC voltage ratio | Internal DC voltage after 24 hr. impression (40□) |
|---|---|---|---|---|---|---|
| 1 | 1 | +7 V | −5 V | 3.500 V | 0.500 | 0.845 V |
| 4 | 2 | +7 V | — | 7.000 V | 1.000 | 2.408 V |
| 7 | 3 | +7 V | −5 V | 6.333 V | 0.905 | 0.932 V |
| 10 | 4 | +7 V | −5 V | 6.333 V | 0.905 | 0.768 V |
| 13 | 5 | +7 V | −5 V | 5.444 V | 0.778 | 0.452 V |
| 16 | 6 | +7 V | −5 V | 4.333 V | 0.619 | 0.332 V |
| 19 | 7 | +7 V | −5 V | 3.000 V | 0.429 | 0.224 V |
| 22 | 8 | +7 V | −5 V | 2.111 V | 0.302 | 0.174 V |
| 25 | 9 | +7 V | −5 V | 1.222 V | 0.175 | 0.083 V |
| 28 | 10 | +7 V | −5 V | 4.333 V | 0.619 | 0.098 V |
| 31 | 11 | +7 V | −5 V | 4.333 V | 0.619 | 0.312 V |
| 34 | 12 | +7 V | −5 V | 4.333 V | 0.619 | 0.141 V |
| 37 | 13 | +7 V | −5 V | 2.000 V | 0.286 | 0.103 V |
| 40 | 14 | +7 V | −5 V | 1.000 V | 0.143 | 0.093 V |
| 43 | 15 | +7 V | −5 V | 0.000 V | 0.000 | 0.031 V |
| 6 | 16 | +7 V | −5 V | −1.000 V | −0.143 | −0.015 V |
| 49 | 17 | +5 V | −5 V | −1.667 V | −0.333 | −0.045 V |
| 52 | 18 | +5 V | −5 V | −1.667 V | −0.333 | −0.038 V |
| 55 | 19 | +5 V | −5 V | −1.667 V | −0.333 | −0.030 V |
| 58 | 5 | −5 V | +7 V | −3.444 V | −0.492 | −0.311 V |
| 61 | 7 | −5 V | +7 V | −1.000 V | −0.143 | −0.155 V |
| 64 | 5 | +7 V | 0 V | 6.093 V | 0.870 | 0.613 V |
| 67 | 7 | +7 V | 0 V | 4.666 V | 0.667 | 0.452 V |
| 70 | 17 | +7 V, −5 V | 0 V | 0.667 V | 0.095 | 0.021 V |

TABLE 2

| Embodiment No. | Drive waveform | Display/ selection waveform voltage | Internal DC voltage control waveform | Effective DC voltage | Effective DC voltage ratio | Internal DC voltage after 24 hr. impression (40□) |
|---|---|---|---|---|---|---|
| 2 | 1 | +7 V | −5 V | 3.500 V | 0.500 | 1.375 V |
| 5 | 2 | +7 V | — | 7.000 V | 1.000 | 2.626 V |
| 8 | 3 | +7 V | −5 V | 6.333 V | 0.905 | 1.131 V |
| 8 | 4 | +7 V | −5 V | 6.333 V | 0.905 | 0.013 V |
| 14 | 5 | +7 V | −5 V | 5.444 V | 0.778 | 0.877 V |
| 17 | 6 | +7 V | −5 V | 4.333 V | 0.619 | 0.491 V |
| 20 | 7 | +7 V | −5 V | 3.000 V | 0.429 | 0.349 V |
| 23 | 8 | +7 V | −5 V | 2.111 V | 0.302 | 0.243 V |
| 26 | 9 | +7 V | −5 V | 1.222 V | 0.175 | 0.105 V |
| 29 | 10 | +7 V | −5 V | 4.333 V | 0.619 | 0.117 V |
| 32 | 11 | +7 V | −5 V | 4.333 V | 0.619 | 0.401 V |
| 35 | 12 | +7 V | −5 V | 4.333 V | 0.619 | 0.165 V |
| 38 | 13 | +7 V | −5 V | 2.000 V | 0.286 | 0.115 V |
| 41 | 14 | +7 V | −5 V | 1.000 V | 0.143 | 0.108 V |
| 44 | 15 | +7 V | −5 V | 0.000 V | 0.000 | 0.041 V |
| 47 | 16 | +7 V | −5 V | −1.000 V | −0.143 | −0.018 V |
| 50 | 17 | +5 V | −5 V | −1.667 V | −0.333 | −0.060 V |

TABLE 2-continued

| Embodiment No. | Drive waveform | Display/ selection waveform voltage | Internal DC voltage control waveform | Effective DC voltage | Effective DC voltage ratio | Internal DC voltage after 24 hr. impression (40□) |
|---|---|---|---|---|---|---|
| 53 | 18 | +5 V | −5 V | −1.667 V | −0.333 | −0.047 V |
| 56 | 19 | +5 V | −5 V | −1.667 V | −0.333 | −0.041 V |
| 59 | 5 | −5 V | +7 V | −3.444 V | −0.492 | −0.401 V |
| 62 | 7 | −5 V | +7 V | −1.000 V | −0.143 | −0.231 V |
| 5 | 5 | +7 V | 0 V | 6.093 V | 0.870 | 0.901 V |
| 68 | 7 | +7 V | 0 V | 4.666 V | 0.667 | 0.601 V |
| 71 | 17 | +7 V, −5 V | 0 V | 0.667 V | 0.095 | 0.035 V |

TABLE 3

| Embodiment No. | Drive waveform | Display/ selection waveform voltage | Internal DC voltage control waveform | Effective DC voltage | Effective DC voltage ratio | Internal DC voltage after 24 hr. impression (40□) |
|---|---|---|---|---|---|---|
| 3 | 1 | +7 V | −5 V | 3.500 V | 0.500 | 0.935 V |
| 6 | 2 | +7 V | — | 7.000 V | 1.000 | 2.486 V |
| 9 | 3 | +7 V | −5 V | 6.333 V | 0.905 | 0.963 V |
| 12 | 4 | +7 V | −5 V | 6.333 V | 0.905 | 0.535 V |
| 5 | 5 | +7 V | −5 V | 5.444 V | 0.778 | 0.332 V |
| 18 | 6 | +7 V | −5 V | 4.333 V | 0.619 | 0.291 V |
| 21 | 7 | +7 V | −5 V | 3.000 V | 0.429 | 0.224 V |
| 24 | 8 | +7 V | −5 V | 2.111 V | 0.302 | 0.181 V |
| 27 | 9 | +7 V | −5 V | 1.222 V | 0.175 | 0.077 V |
| 30 | 10 | +7 V | −5 V | 4.333 V | 0.619 | 0.009 V |
| 33 | 11 | +7 V | −5 V | 4.333 V | 0.619 | 0.234 V |
| 36 | 12 | +7 V | −5 V | 4.333 V | 0.619 | 0.137 V |
| 39 | 13 | +7 V | −5 V | 2.000 V | 0.286 | 0.094 V |
| 42 | 14 | +7 V | −5 V | 1.000 V | 0.143 | 0.088 V |
| 45 | 15 | +7 V | −5 V | 0.000 V | 0.000 | 0.033 V |
| 48 | 16 | +7 V | −5 V | −1.000 V | −0.143 | −0.011 V |
| 51 | 17 | +5 V | −5 V | −1.667 V | −0.333 | −0.036 V |
| 54 | 18 | +5 V | −5 V | −1.667 V | −0.333 | −0.040 V |
| 57 | 19 | +5 V | −5 V | −1.667 V | −0.333 | −0.036 V |
| 60 | 5 | −5 V | +7 V | −3.444 V | −0.492 | −0.220 V |
| 63 | 7 | −5 V | +7 V | −1.000 V | −0.143 | −0.161 V |
| 66 | 5 | +7 V | 0 V | 6.093 V | 0.870 | 0.593 V |
| 69 | 7 | +7 V | 0 V | 4.666 V | 0.667 | 0.357 V |
| 72 | 17 | +7 V, −5 V | 0 V | 0.667 V | 0.095 | 0.024 V |

Here, for drive voltage waveforms 1 through 16, display/selection waveform V1=+7V and internal DC voltage control waveform voltage V2=−5V, while for drive voltage waveforms 17 through 19, display/selection waveform V1=+5V and internal DC voltage control waveform voltage V2=−5V.

In addition, there are also different versions of drive voltage waveforms 5 and 7 which use a combination of V1=−5V and V2=+7V, and a combination of V1=+7V and V2=0 V.

Also, there is a different version of drive voltage waveform 17 which uses a combination of V1=+7V or −5V and V2=0 V.

TABLE 4

| Embodiment No. | Drive waveform | Display/ selection waveform voltage | Internal DC voltage control waveform | Effective DC voltage | Effective DC voltage ratio | Internal DC voltage after 24 hr. impression (40□) |
|---|---|---|---|---|---|---|
| 73 | 20 | +5 V | — | 1.666 V | 0.333 | 1.600 V |
| 76 | 21 | −5 V | −5 V | 1.481 V | 0.296 | 1.420 V |
| 79 | 22 | −5 V | −5 V | 1.481 V | 0.296 | 1.335 V |
| 82 | 23 | −5 V | −5 V | 1.235 V | 0.247 | 1.015 V |
| 85 | 24 | −5 V | −5 V | 0.926 V | 0.185 | 0.605 V |
| 88 | 25 | −5 V | −5 V | 0.555 V | 0.111 | 0.263 V |
| 91 | 26 | −5 V | −5 V | 0.306 V | 0.061 | 0.098 V |
| 94 | 27 | −5 V | −5 V | 0.062 V | 0.012 | 0.011 V |
| 97 | 28 | −5 V | −5 V | 0.432 V | 0.086 | 0.115 V |
| 100 | 29 | −5 V | −5 V | 0.268 V | 0.054 | 0.063 V |
| 103 | 30 | −5 V | −5 V | 0.062 V | 0.012 | −0.102 V |

TABLE 5

| Embodiment No. | Drive waveform | Display/ selection waveform voltage | Internal DC voltage control waveform | Effective DC voltage | Effective DC voltage ratio | Internal DC voltage after 24 hr. impression (40□) |
|---|---|---|---|---|---|---|
| 74 | 20 | +5 V | — | 1.666 V | 0.333 | 1.636 V |
| 77 | 21 | −5 V | −5 V | 1.481 V | 0.296 | 1.431 V |
| 80 | 22 | −5 V | −5 V | 1.481 V | 0.296 | 1.358 V |
| 83 | 23 | −5 V | −5 V | 1.235 V | 0.247 | 1.082 V |
| 86 | 24 | −5 V | −5 V | 0.926 V | 0.185 | 0.632 V |
| 89 | 25 | −5 V | −5 V | 0.555 V | 0.111 | 0.283 V |
| 92 | 26 | −5 V | −5 V | 0.306 V | 0.061 | 0.105 V |
| 95 | 27 | −5 V | −5 V | 0.062 V | 0.012 | 0.031 V |
| 98 | 28 | −5 V | −5 V | 0.432 V | 0.086 | 0.131 V |
| 101 | 29 | −5 V | −5 V | 0.268 V | 0.054 | 0.085 V |
| 104 | 30 | −5 V | −5 V | 0.062 V | 0.012 | −0.121 V |

TABLE 6

| Embodiment No. | Drive waveform | Display/ selection waveform voltage | Internal DC voltage control waveform | Effective DC voltage | Effective DC voltage ratio | Internal DC voltage after 24 hr. impression (40□) |
|---|---|---|---|---|---|---|
| 75 | 20 | +5 V | — | 1.666 V | 0.333 | 1.608 V |
| 78 | 21 | −5 V | −5 V | 1.481 V | 0.296 | 1.389 V |
| 81 | 22 | −5 V | −5 V | 1.481 V | 0.296 | 0.338 V |
| 84 | 23 | −5 V | −5 V | 1.235 V | 0.247 | 0.005 V |
| 87 | 24 | −5 V | −5 V | 0.926 V | 0.185 | 0.591 V |
| 90 | 25 | −5 V | −5 V | 0.555 V | 0.111 | 0.251 V |
| 93 | 26 | −5 V | −5 V | 0.306 V | 0.061 | 0.093 V |
| 96 | 27 | −5 V | −5 V | 0.062 V | 0.012 | 0.013 V |
| 99 | 28 | −5 V | −5 V | 0.432 V | 0.086 | 0.120 V |
| 102 | 29 | −5 V | −5 V | 0.268 V | 0.054 | 0.061 V |
| 105 | 30 | −5 V | −5 V | 0.062 V | 0.012 | −0.095 V |

For drive voltage waveforms 20 through 30, display/selection waveform V1=+5V and internal DC voltage control waveform voltage V2=−5V.

(9) Asymmetric Parameter for Voltage Integrated Intensity per Unit Time in the Drive Voltage Waveforms Used in the Present Invention For drive voltage waveforms 1 through 30 used in the present invention, as shown in Tables 1 though 3 and Tables 4 through 6, based on the drive voltages described earlier in (7), the voltage integrated intensity per unit time has been calculated as a value normalized by the maximum absolute value of impressed voltage for the entire waveform (integrated intensity asymmetric parameter R).

If a drive voltage waveform is continuously impressed on a cell as described below at 40□, the amounts of accumulation of internal DC voltage after 24 hours of impression are listed in Tables 1 through 3 and Tables 4 through 6.

In embodiments 1 through 72, the alignment layer used is a PI alignment layer and the liquid crystal materials used in the embodiments listed in Table 1, Table 2 and Table 3 are CS-1031, CS-1025 and CS-1028, respectively.

In embodiments 73 through 105, the alignment layer used is an obliquely evaporated SiO layer, and the liquid crystal materials used in the embodiments listed in Table 4, Table 5 and Table 6 are CS-1031, CS-1025 and CS-1028, respectively.

As clearly seen from Tables 1 through 3, the amount of accumulation of internal DC voltage depends not on the liquid crystal material used but on the type of drive voltage waveform: the same type of waveform delivers the same type of profile. When "drive voltage waveform 2," which has no internal DC voltage control waveform, is used, the level of accumulated DC voltage reaches approx. 2.5 V.

When positive voltage waveform is used for the whole display/selection period, even if the ratio of inserted internal DC voltage control waveform is only 5.6% or so as in the case of "drive voltage waveform 3" and "drive voltage waveform 4," an effect of reducing internal DC voltage can be observed: the internal DC voltage level becomes as low as 1V or less. As the ratio of internal DC voltage control waveform is increased, the level of internal DC voltage is dramatically decreased: it finally goes down to zero or so.

As compared with drive voltage waveforms 4 through 9 in which 108 bit planes are treated as one unit and the ratio of internal DC voltage control period is varied, drive voltage waveform 1, in which the ratio of internal DC voltage control period is 25%, is as effective as drive voltage waveform 4 in which the ratio of internal DC voltage control period is only 5.6%. It has been confirmed that, because a smaller ratio of internal DC voltage control waveform period is better in terms of display characteristics, the effect of insertion of internal DC voltage control waveform on a per-108-bit-planes basis (one frame 16.6 msec or less) is larger than on a per-bit-plane basis (or 154.3 μsec). The reason for this seems to relate to the polarization and relaxation speeds resulting from ion movement in the panel; polarized ions do not response to a high frequency of waveform in the internal DC voltage control period.

Among drive voltage waveforms 10 through 12 in which 3.6 msec (24 bit planes) internal DC voltage control period is inserted in divided form, the accumulation of internal DC voltage for drive voltage waveform 11 of which control period is divided into 9 parts is larger than that for drive voltage waveforms 10 (3 parts) and 12 (12 parts). The effectiveness of drive voltage waveform 6 of which control period is not divided is almost the same as that of drive voltage waveform 11. These results demonstrate that division of internal DC voltage control period into a certain number of parts, for example, 3 or 12 parts, is more effective in reducing the accumulation of internal DC voltage.

For drive voltage waveforms 7 and 13 through 16 in which the ratio of positive voltage waveform to negative voltage waveform for the display/selection waveform period is varied step by step from 100% to 50% and negative voltage is impressed for the internal DC voltage control period, the accumulation of internal DC voltage is almost zero. Particularly, even for drive voltage waveforms 16 through 19 in which internal DC voltage is not accumulated in the display/selection waveform period but such accumulation occurs due to impression of negative voltage in the internal DC voltage control period, the level of internal DC voltage (negative) is very low or virtually zero.

For embodiments 58 through 63 in which, contrary to the above, negative voltage waveform is used for all the display/selection waveform periods and positive voltage waveform is used for the internal DC voltage control period, it has been confirmed that the accumulation of internal DC voltage can be controlled.

As compared with embodiments 13 through 15 and 19 through 21 based on drive voltage waveform 5 or 7 in which positive voltage waveform is used for the entire display/selection period and 14 or 36 bit planes of negative voltage waveform are inserted for the internal DC voltage control period, it has been confirmed that the effect of reducing internal DC voltage is very low in the case of embodiments 64 through 66 and 67 through 69 in which 0 V voltage waveform is inserted for the internal DC voltage control period.

It has also been confirmed that the accumulation of internal DC voltage is within the tolerable range for embodiments 70 through 72 in which no internal DC voltage accumulation occurs in the display/selection period and 0 V is impressed for the internal DC voltage control waveform period.

As clearly seen from Tables 4 through 6, the amount of accumulation of internal DC voltage depends not on the liquid crystal material used but on the type of drive voltage waveform; the same type of waveform delivers the same type of profile. Also a comparison is made between two types of alignment layers: embodiments 1 through 72 which use PI films are compared with embodiments 73 through 105 which use obliquely evaporated SiO films. The amount of accumulation of internal DC voltage is much larger in the latter type of film than in the former type of film. Particularly, for the embodiments which have no internal DC voltage control period or have a very short internal DC voltage control period, almost all of the effective DC voltage component of the impressed drive voltage waveform is accumulated as internal DC voltage. This difference between PI film and obliquely evaporated SiO film is caused by the fact that, even if the same liquid crystal material is used, the quantity of ions in the assembled panel is larger by one digit or more in the latter film type than in the former film type.

For drive voltage waveforms 20, and 22 through 27, as the ratio of internal DC voltage control period is increased, the amount of accumulation of internal DC voltage can be reduced. For drive voltage waveforms 28 through 30 in which negative DC voltage pulse waveform is used in place of the pulse waveform as used in the internal DC voltage control period for drive voltage waveforms 22 through 24, it has been confirmed that the amount of accumulation of internal DC voltage is much smaller than with the latter pulse waveform.

Figure 31:
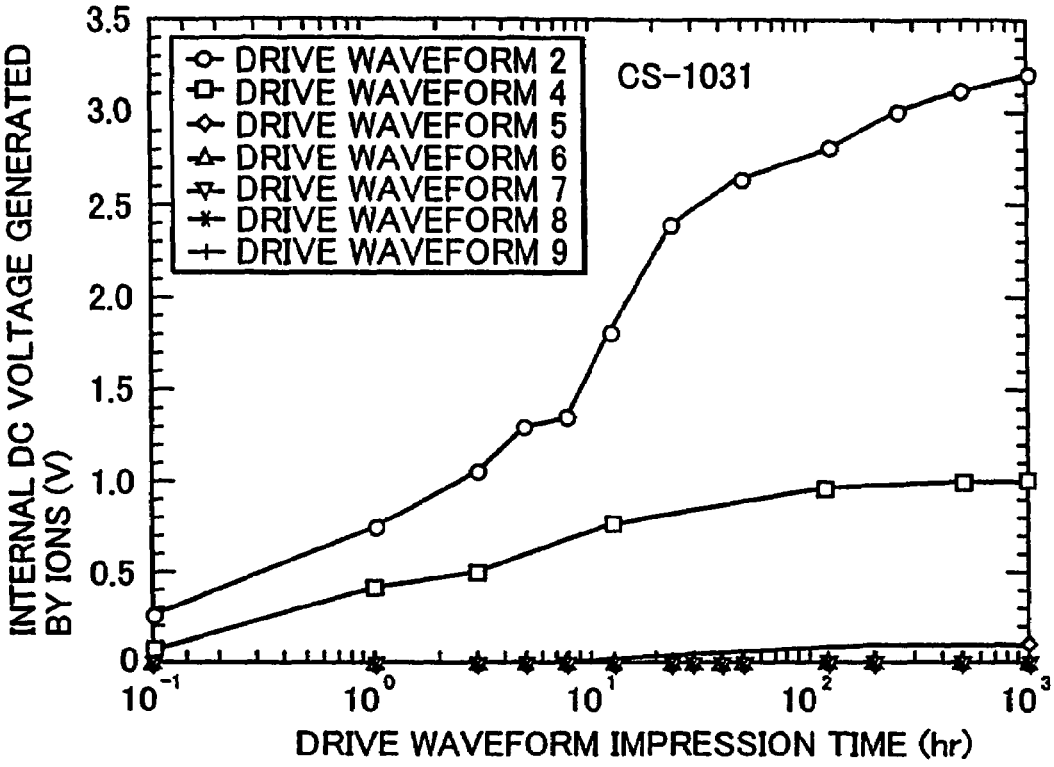
FIG. 31 is a graph showing internal DC voltage accumulation vs. time of impression of drive voltage waveforms 2 through 9 for the above-said LCD.
Figure 32:
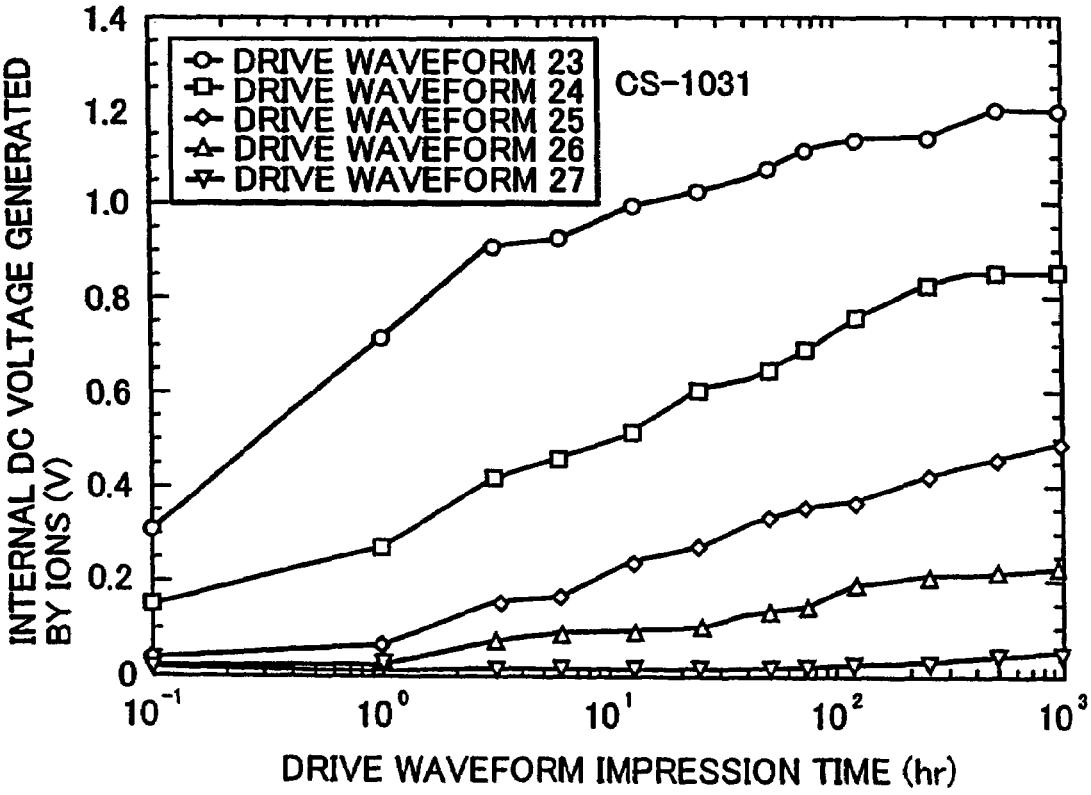
FIG. 32 is a graph showing internal DC voltage accumulation vs. time of impression of drive voltage waveforms 23 through 27 for the above-said LCD.

FIGS. 31 and 32 show how much internal DC voltage accumulates due to ions as the voltage impression time increases, when the CS-1031 liquid crystal material is used and different drive voltage waveforms are impressed on cells at 40□. FIG. 31 shows the results for drive voltage waveforms 2 and 4 through 9, while FIG. 32 shows the results for drive voltage waveforms 23 through 27.

It can be understood from Table 31 that for drive voltage waveform 2, which has no internal DC voltage control waveform inserted, the accumulation of internal DC voltage sharply increases as the voltage impression time increases. There is a tendency that the accumulation of internal DC voltage decreases with increase in the ratio of internal DC voltage control waveform period to the whole waveform period. In case of drive voltage waveform 4, although the time ratio of internal DC voltage control period is as low as 5.6%, the accumulation of internal DC voltage does not exceed 1.0 V or so after 1000 hours of continuous impression. As compared with 2.5 V as a result of 24 hours of impression of drive voltage waveform 2 which has no internal DC voltage control period, this amount of accumulation is obviously small, so insertion of internal DC voltage control waveform is apparently effective.

For drive voltage waveforms 5 through 9 which have a higher time ratio of internal DC voltage control period than drive voltage waveform 4, the accumulation of internal DC voltage is more effectively reduced: it is almost zero even after 1000 hours of continuous impression.

In panels which use obliquely evaporated SiO films, due to a larger quantity of ions, the speed of internal DC voltage accumulation is faster than in the case of using PI alignment layers as shown in FIG. 31 and it is clear from FIG. 32 that the amount of accumulation of internal DC voltage with the increase in drive voltage waveform impression time is larger than in the case of using PI alignment layers. After 1000 hours of drive voltage waveform impression, the level of accumulated internal DC voltage is almost equivalent to the level of the effective DC voltage of the impressed waveform. However, as the time ratio of internal DC voltage control period increases, it takes a longer time for accumulated internal DC voltage to reach the effective DC voltage of the impressed waveform.

Therefore, for panels which use obliquely evaporated SiO films and thus have many ions, insertion of internal DC voltage control waveform is less effective in reducing internal DC voltage accumulation.

According to the above-mentioned embodiments of the present invention, the drive for selecting either the On state or Off state is done by the voltage waveform generated by the effective internal DC voltage in the selection period, and a waveform for controlling (reducing) the level of internal DC voltage which does not practically contribute to liquid crystal drive, like reverse polarity voltage waveform, is inserted in a certain period, so that the accumulation of internal DC voltage can be substantially reduced.

Ideally, the time of insertion of reverse polarity voltage waveform should be the same as the time of impression of drive voltage waveform (impressed voltage) for selection of a liquid crystal state, so that the state of electrical neutrality is attained.

Instead, by inserting it for a shorter period, internal DC voltage generated by impurity ions can also be very effectively reduced. Thus, LCD drive conditions which prevent display trouble and ensure high display reliability over an extended period have been found.

Namely, the accumulation of internal DC voltage can be reduced by increasing the ratio of internal DC voltage control period up to 50% of the whole waveform period as far as possible. However, when it is 50%, the ratio of the internal DC voltage control period to the drive period for selection of one liquid crystal state is 1:1, which is the same as in conventional LCD drive methods. Besides, an increase in the ratio of internal DC voltage control period necessitates a decrease in bit plane time, which might cause deterioration in display characteristics such as picture brightness and gradations.

Taking into consideration this conflicting result, the conditions for the waveform for controlling (reducing) the level of internal DC voltage without deteriorating the displayed picture brightness or gradations are that the ratio of internal DC voltage control period should be preferably 5% or more and less than 50% per unit time for each field, and more preferably within the range from 10% to 35%.

The polarity of the internal DC voltage control waveform to be inserted into the drive voltage waveform should be the reverse of the dominant polarity of voltage signals (positive or negative) generated in the display waveform period. For this reason, a mechanism for determining which polarity the inserted internal DC voltage control waveform should have should be incorporated in the drive circuit.

In the display waveform period, it is not always necessary to generate internal DC voltage control waveform whose polarity is the reverse of the dominant polarity which is decided according to the difference between the numbers of positive-voltage-dominant bit planes and negative-voltage-dominant ones. If the polarity of internal DC voltage control waveform is decided only according to the difference in the number of bit planes, particularly when the number of positive-voltage-dominant bit planes and that of negative-voltage-dominant ones are almost equal, the polarity of control voltage waveform may reverse the moment the difference in the number of bit planes reaches a certain level.

Consequently, depending on the voltage of each of bit plane waveforms (A through E) as drive voltage waveforms shown in FIGS. 13 through 17, the drive method should be designed so that the field strength per unit time for impressed voltage is minimized, or the point of polarity inversion in the internal DC voltage control period should be determined by actually measuring the internal DC voltage with variation in the above-said difference, so that the internal DC voltage is minimized.

According to the above-mentioned embodiments of the invention, it is possible to provide an LCD which displays high definition pictures with high contrast and can represent gradations within pixels, and features high reliability, low power consumption and compactness (low profile)/lightness. Another advantage of the present invention is that the LCD manufacturing process can be shortened to realize improved productivity and cost reduction, which implies that LCDs with satisfactory display characteristics can be manufactured at lower cost and also projection type displays based on this LCD technology can be provided.

The present invention may be embodied in other specific forms without departing from the technological concept thereof. For instance, the above-said drive voltage waveforms and other drive conditions may be varied as far as the object of the invention can be achieved. Regarding choices for selection of one of two states of incident light in LCDs, in the above-mentioned embodiments, choice between reflected and non-reflected light, or between transmitted and non-transmitted light is made; however, it is also acceptable that a choice is made between polarized and non-polarized light or between twisted and non-twisted light by selecting the On state or the Off state practically.

In the LCD drive method according to the present invention, an LCD has the following structure: a first electrode located on a first substrate and a second electrode located on a second substrate are facing each other and liquid crystal material is filled and sealed between the substrates. In the drive method for the LCD which displays pictures by means of the voltage signal impressed between the first and second electrodes to select the state of incident light, generation of internal DC voltage which may be caused by ionic polarization in liquid crystal cells can be efficiently reduced by using drive voltage waveform consisting of a display signal period and a control signal period irrelevant to display, within a given drive time, or a period of plural frames or one frame.

In other words, the present invention provides a simple LCD drive method which guarantees a sufficient bit plane time, preventing deterioration in display picture quality due to impurity ions.

What is claimed is:

1. A liquid crystal display drive method for a liquid crystal display having a first electrode located on a first substrate and a second electrode located on a second substrate, said first substrate and said second substrate facing each other with liquid crystal filled therebetween, the method comprising the steps of:

displaying pictures using a voltage signal impressed between said first and second electrodes to select one state of incident light which is (a) either reflected or non-reflected, (b) either transmitted or non-transmitted, (c) either polarized or non-polarized, or (d) twisted or non-twisted;

applying a drive voltage waveform having a display signal period and a control signal period irrelevant to display within a given drive time, a period of plural frames, or one frame; and choosing one of an on state and an off state to select the one state of incident light in said display signal period, wherein, a time ratio of said control signal period to a whole period of the drive voltage waveform is between 5% and 50%.

2. The liquid crystal display drive method as claimed in claim 1 further comprising the step of:

applying a next selection signal when one of the on state and the off state which is longer than the response time of said liquid crystal is to be held, wherein, the next selection signal is applied after application of a voltage signal while maintaining the desired transmittance or reflectance.

3. The liquid crystal display drive method as claimed in claim 1 wherein said liquid crystal is a ferroelectric liquid crystal or antiferroelectric liquid crystal.

4. A liquid crystal display drive method for a liquid crystal display having a first electrode located on a first substrate and a second electrode located on a second substrate, said first substrate and said second substrate facing each other with liquid crystal filled therebetween, the method comprising the steps of:

displaying pictures using a voltage signal impressed between said first and second electrodes to select one state of incident light which is (a) either reflected or non-reflected, (b) either transmitted or non-transmitted, (c) either polarized or non-polarized, or (d) twisted or non-twisted;

applying a drive voltage waveform having a display signal period and a control signal period irrelevant to display within a given drive time, a period of plural frames, or one frame; and choosing one of an on state and an off state to select the one state of incident light in said display signal period, wherein the liquid crystal display is a reflective liquid crystal display including a silicone back plane and a ferroelectric liquid crystal.

5. The liquid crystal display drive method as claimed in claim 1 further comprising:

selecting one of the on state and the off state during said display signal period by applying a combination of positive and negative voltages and/or 0 V as the voltage signal for the drive voltage waveform.

6. The liquid crystal display drive method as claimed in claim 5 wherein:

said drive voltage waveform is a combination of positive voltage and negative voltage signals and/or 0 V signal;

the absolute values of these voltages or their signal widths are different; and the waveform has an imbalance in positive and negative charges.

7. The liquid crystal display drive method as claimed in claim 6 further comprising the step of:

impressing, during said control signal period, a reset voltage which has the polarity opposite to that of drive voltage waveform during said display signal period or is continuous DC voltage to suppress generation of internal DC voltage caused by ionic polarization in the liquid crystal.

8. The liquid crystal display drive method as claimed in claim 4 wherein a time ratio of said control signal period to a whole drive voltage waveform period is between 5% and 50%.

9. The liquid crystal display drive method as claimed in claim 7 further comprising:

suppressing generation of internal DC voltage caused by ionic polarization in the liquid crystal by determining a voltage polarity and level in said control signal period via a detection circuit to detect an electric charge imbalance which occurs in a given time or a period of plural frames or one frame.

10. The liquid crystal display drive method as claimed in claim 1 wherein, during said display signal period, the voltage signal for selecting one of the on state and the off state, is a combination of positive voltages only and the voltage signal for selecting the other state is a combination of negative voltages only and such drive voltage waveform is used.

11. The liquid crystal display drive method as claimed in claim 10 wherein:

said drive voltage waveform is a combination of positive voltage and negative voltage signals and/or 0 V signal;

the absolute values of these voltages or their signal widths are different; and the waveform has an imbalance in positive and negative charges as the impressed voltage waveform in the period of selection of one state.

12. The liquid crystal display drive method as claimed in claim 11 further comprising the step of:

impressing, during said control signal period, a reset voltage which has the polarity opposite to that of drive voltage waveform in said display signal period or is continuous DC voltage to suppress generation of internal DC voltage, caused by ionic polarization in the liquid crystal.

13. The liquid crystal display drive method as claimed in claim 12 further comprising the step of:

suppressing generation of internal DC voltage caused by ionic polarization in the liquid crystal by determining the voltage polarity and level in the control signal period via a detection circuit to detect an electric charge imbalance in a given time or a period of plural frames or one frame.

* * * * *